US009981770B2

(12) United States Patent
Mundt

(10) Patent No.: US 9,981,770 B2
(45) Date of Patent: May 29, 2018

(54) PACKAGING WITH A RETRACTABLE HANDLE AND METHODS OF MAKING THE SAME

(71) Applicant: Apple Inc., Cupertino, CA (US)

(72) Inventor: Matthew Mundt, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

(21) Appl. No.: 15/061,811

(22) Filed: Mar. 4, 2016

(65) Prior Publication Data

US 2017/0253367 A1 Sep. 7, 2017

(51) Int. Cl.
*B65D 5/46* (2006.01)

(52) U.S. Cl.
CPC ..... *B65D 5/46112* (2013.01)

(58) Field of Classification Search
CPC ..... B65D 5/46112; B65D 2571/00481; B65D 2571/00512
USPC ..... 229/117.14, 117.22, 117.12, 117.13, 229/117.19, 902
See application file for complete search history.

(56) References Cited

U.S. PATENT DOCUMENTS 6,182,465 B1 * 2/2001 Ricci ..... B65D 5/244 62/371
7,967,186 B2 * 6/2011 Brandinelli ..... B65D 5/46032 229/117.19
2001/0004088 A1 * 6/2001 Lau ..... B65D 5/2033 229/117.15
2016/0039559 A1 * 2/2016 Williams ..... B65D 5/001 229/151

* cited by examiner

*Primary Examiner* — Christopher Demeree
(74) *Attorney, Agent, or Firm* — Sterne, Kessler, Goldstein & Fox P.L.L.C.

(57) ABSTRACT

Packaging for a product including a retractable handle. The retractable handle may be a foldable retractable handle configured to fold and unfold between a retracted position and an erect position. In the retracted position, retractable handle may be disposed with a body of the packaging. In the erect position, the retractable handle may extend from the body of the packaging. In some embodiments, the retractable handle may be composed of a paper-based material. In some embodiments, the retractable handle may be a single integrally formed piece of material.

36 Claims, 19 Drawing Sheets

PACKAGING WITH A RETRACTABLE HANDLE AND METHODS OF MAKING THE SAME

FIELD

The described embodiments relate generally to packaging for consumer products. More particularly, the described embodiments relate to packaging for consumer products including a retractable handle.

BACKGROUND

Packaging for consumer products protects the products from damage and facilitates brand recognition. Effective packaging can be an important marketing tool used to attract and retain customers.

SUMMARY

Packaging for consumer products should protect the products during shipping and handling. But, while protection of products may be important, a consumer's impression of the packaging may also be important. Packaging having unique, attention-grabbing, and/or aesthetically pleasing features can enhance a consumer's impression of the packaging, and therefore the consumer's impression of the manufacturer of the product within the packaging. Further, packaging that is easy for a consumer to carry may be desirable. Packaging that is easy to carry may reduce the chance of the packaging being dropped and reduce the possibility of damage to the product within the packaging. A handle configured to be gripped by a consumer is one way to provide an easy way for consumers to carry a package.

While consumer impression and ease of carrying a package may be desirable from a consumer standpoint, efficiency and cost in manufacturing and shipping packaging may be a consideration for manufactures and/or sellers of the packaging and/or the products within the packaging. For example, environmental considerations may play a role in developing and manufacturing packaging. Packaging made out of recyclable and/or biodegradable materials can reduce environmental impact. Additionally, packaging that utilizes minimal resources, from a material, energy, and/or labor perspective, may be desirable. Packaging that requires a relatively small number of manufacturing and/or assembly steps may also reduce costs (e.g., manpower and machine costs) associated with the packaging. Additionally, the space required to ship and store a package may be a consideration. Reducing the space required to transport/store a package may reduce shipping/storage costs by increasing the number of packages that can be shipped/stored per unit volume.

Maintaining desired aesthetics and function of packaging in view of such environmental, manufacturing, and shipping considerations can be a challenge. The packaging according to embodiments described herein, or elements thereof, accomplish one or more of these and other objectives.

Some embodiments are directed towards packaging for a product, the packaging including an opening and opposing wings configured to at least partially cover the opening, each wing hingedly coupled to the packaging and including a slot. The packaging also having a retractable handle including a first foldable wall coupled to a second foldable wall at a retractable end of the retractable handle, the first foldable wall including a fixed end coupled to a first internal surface of the packaging and the second foldable wall including a fixed end coupled to a second internal surface of the packaging, a handgrip at the retractable end of the retractable handle, and opposing tabs disposed at the retractable end and configured to slide within the slots on the wings of the packaging; the retractable handle being configured to fold and unfold between a retracted position and an erect position, where the retractable end of the retractable handle is disposed within the packaging in the retracted position the retractable end of the retractable handle extends above the opening and the opposing tabs are disposed within the slots of the opposing wings in the erect position.

In some embodiments, the retractable handle may be a single integrally formed piece. In some embodiments, the retractable handle may be formed of a paper-based material selected from the group of cardboard and paperboard.

In some embodiments, the opposing tabs may be configured to mate with upper ends of the slots on the wings when the retractable handle is in the erect position. In some embodiments, the opposing tabs may be configured to extend through the slots on the wings when the retractable handle is in the erect position.

In some embodiments, the packaging may include a pull tab coupled to the retractable end of the retractable handle and pulling the pull tab may move the retractable handle from the retracted position to the erect position.

In some embodiments, the first foldable wall and the second foldable wall may be substantially the same. In some embodiments, the first foldable wall and the second foldable wall may each include a first panel coupled to the packaging and defining the fixed end of the foldable wall, a second panel hingedly coupled to the first panel, a third panel hingedly coupled to the second panel, and a fourth panel hingedly coupled to the third panel, the fourth panels of the foldable walls defining at least a portion of the retractable end of the retractable handle. In some embodiments, the third panels of the first foldable wall and the second foldable wall may be configured to bias the retractable handle in the retracted position until the retractable handle is moved a predetermined amount from the retracted position towards the erect position. In some embodiments, the handgrip may include a through hole defined by the first foldable wall and the second foldable wall.

In some embodiments, the packaging may include a spine, a first section hingedly coupled to the spine and a second section hingedly coupled to the spine, and the first section and the second section may be configured to rotate away from and towards each other between an open position and a closed position to open and close the packaging. In some embodiments, the opening for the retractable handle may be disposed on the spine. In some embodiments, the first section may include a first cavity and the second section may include a second cavity, and the first cavity and the second cavity may define a product cavity for holding a product.

In some embodiments, the packaging may include a cord having one end coupled to the retractable handle and another end coupled to the first internal surface of the packaging, and the cord may be configured to bias the retractable handle in the retracted position when the first section is in the open position.

In some embodiments, the first section may define the first internal surface of the packaging and the second section may define the second internal surface of the packaging. In some embodiments, the first section may include a first cavity defined by the first internal surface and a first frame disposed along at least a portion of the perimeter of the first section and the second section may include a second cavity defined by the second internal surface and a second frame disposed along at least a portion of the perimeter of the second section. In some embodiments, the first cavity and the second cavity may define a closed product cavity when the first section and the second section are in the closed position.

In some embodiments, the wings may be integrally formed with the packaging. In some embodiments, the wings may define a portion of the spine. In some embodiments, the wings may be hingedly coupled to opposing peripheral portions of the spine. In some embodiments, the slots on the wings may extend from the wings onto the opposing peripheral portions of the spine.

Some embodiments are directed towards packaging for a product, the packaging including a packaging body composed of a paper-based material and a retractable handle composed of a paper-based material, the retractable handle including a first foldable wall and a second foldable wall and each foldable wall may include a first panel coupled the packaging body and defining the fixed end of the foldable wall, a second panel hingedly coupled to the first panel, a third panel hingedly coupled to the second panel, a fourth panel hingedly coupled to the third panel, the fourth panels of the foldable walls defining at least a portion of a retractable end of the retractable handle. A handgrip including a through hole may be defined by the first foldable wall and the second foldable wall and the retractable handle may be configured to fold and unfold between a retracted position and an erect position, where the retractable handle is disposed within the packaging in the retracted position and extends from the packaging in the erect position.

In some embodiments, the paper-based material may selected from the group of cardboard and paperboard. In some embodiments, the first foldable wall and the second foldable wall may be a single integrally formed piece. In some embodiments, the handgrip may be defined by the third and fourth panels of the first foldable wall and the second foldable wall.

In some embodiments, the packaging may include an opening and opposing wings hingedly coupled to opposite sides of the opening. In some embodiments, the retractable handle may be configured to fold and unfold from the opening.

In some embodiments, the fourth panel of the first foldable wall and the fourth panel of the second foldable wall may include opposing tabs disposed on opposite sides of the first foldable wall and the second foldable wall and the opposing tabs may be configured to slide within opposing slots defined by the opposing wings as the retractable handle is folded and unfolded.

In some embodiments, the packaging body may be a single integrally formed piece. In some embodiments, the packaging body may include a cavity for holding a product.

In some embodiments, the third panels of the first foldable wall and the second foldable wall may be configured to bias the retractable handle in the retracted position until the retractable handle is moved a predetermined amount from the retracted position towards the erect position. In some embodiments, the predetermined amount may be greater than half way between the retracted position and the erect position.

In some embodiments, the third panels of the first foldable wall and the second foldable wall may be configured to bias the retractable handle in the retracted position until the third panels are moved past a predetermined position. In some embodiments, the predetermined position may be substantially perpendicular to the first internal surface of the packaging.

In some embodiments, the opposing tabs of the retractable handle may be defined by the fourth panels of the first foldable wall and the second foldable wall. In some embodiments, the handgrip may include a through hole defined by the first foldable wall and the second foldable wall. In some embodiments, the though hole may be defined by the third and fourth panels of the first foldable wall and the second foldable wall. In some embodiments, the though hole may extend through hinged couplings that hingedly couple the third panel and the fourth panel of the first foldable wall and the third panel and the fourth panel of the second foldable wall.

Some embodiments are directed towards packaging for a product, the packaging including a spine, a first section including a fixed end hingedly coupled to the spine and a free end opposing the fixed end including a first flap hingedly coupled to the free end, a second section including a fixed end hingedly coupled to the spine and a free end opposing the fixed end including a second flap hingedly coupled to the free end, and a retractable handle including a first foldable wall having a first end coupled to the first flap and a second end disposed opposite the first end, a second foldable wall having a first end coupled to the second flap and a second end disposed opposite the first end, where the first flap and the second flap are configured rotate between a closed position and an open position, the first foldable wall and second foldable wall are concealed when the flaps are in the closed position and the first foldable wall and the second foldable wall are exposed wherein the flaps are in the open position, and the second ends of the first foldable wall and the second foldable wall are configured to define a handgrip of the retractable handle when the first flap and the second flap are in the open position.

In some embodiments, the first section may include a first cavity and the second section may include a second cavity and the first cavity and the second cavity may define a product cavity for holding a product.

In some embodiments, the first section and the second section may be configured to rotate away from and towards each other between an open position and a closed position to open and close the packaging. In some embodiments, the first cavity and the second cavity may define a closed product cavity when the first section and the second section are in the closed position. In some embodiments, the first flap and the second flap may be disposed in a back-to-back configuration when the first section and the second section are in the closed position.

In some embodiments, the packaging may include a first compartment defined by the first section and reversibly covered by the first flap and a second compartment defined by the second section and reversibly covered by the second flap. In some embodiments, the first compartment may be configured to house the first foldable wall when the first flap is in the closed position and the second compartment may be configured to house the second foldable wall when the second flap is in the closed position.

In some embodiments, the second ends of the first foldable wall and the second foldable wall may be configured to be coupled together to define the handgrip of the retractable handle when the first flap and the second flap are in the open position.

Some embodiments are directed towards a blank for forming a retractable handle for product packaging, the blank including a first handle wall including a first panel connected to a second panel by a first fold line, the first panel including a first set of tabs disposed on opposing side edges of the first panel and a first through hole formed in the first panel and the second panel, and a second handle wall including a third panel connected to a fourth panel by a second fold line, the third panel including a second set of tabs disposed on opposing side edges of the third panel and a second through hole formed in the third panel and the fourth panel, where the first panel is connected to the third panel by a third fold line and the first panel, the third panel, the first through hole, and the second through hole are configured to form at least a portion of a handgrip for the retractable handle.

In some embodiments, the first fold line and the second fold line may be downward fold lines and the third fold line may be an upward fold line. In some embodiments, the first handle wall may be substantially the same as the second handle wall.

In some embodiments, the first set of tabs and the second set of tabs may have bilateral symmetry about the third fold line. In some embodiments, the first panel and the third panel may have bilateral symmetry about the third fold line.

In some embodiments, the blank may include a fifth panel connected to the second panel by a fourth fold line and a sixth panel connected to the fourth panel by a fifth fold line. In some embodiments, the fourth fold lines and the fifth fold line may be upward fold lines.

In some embodiments, the blank may include a seventh panel connected to the fifth panel by a sixth fold line and an eighth panel connected to the sixth panel by a seventh fold line. In some embodiments, the sixth fold line and the seventh fold line may be upward fold lines.

Some embodiments are directed towards a set of blanks for product packaging, the set including a blank for forming a retractable handle and a packaging body blank including a spine hingedly coupled to a first section along a first side of the spine by a first fold line and hingedly coupled to a second section along a second side of the spine by a second fold line and a pair of opposing wings hingedly coupled to the spine between the first side and second side of the spine by a third fold line and fourth fold line, respectively.

Some embodiments are directed towards a method of making packaging for a product, the method including cutting a packaging blank from a paper-based material, where cutting the packaging blank includes cutting two opposing wings from the paper-based material such that the wings are hingedly coupled to the packaging blank, cutting a retractable handle blank from a paper-based material, folding the retractable handle blank along fold lines disposed on the retractable handle blank, coupling the retractable handle blank to the packaging blank, and folding the packaging blank into packaging for a product.

In some embodiments, cutting the retractable handle blank may include cutting a first foldable wall and a second foldable wall such that the first foldable wall and the second foldable wall are substantially symmetrical about a center line of the retractable handle blank. In some embodiments, the center line may be a fold line. In some embodiments, cutting the retractable handle blank may include cutting a first through hole in the first foldable wall and cutting a second through hole in the second foldable wall such that the first through hole and second through hole are disposed symmetrically on opposite sides of the center line. In some embodiments, cutting the retractable handle blank may include cutting a set of opposing tabs on the first foldable wall and a set of opposing tabs on the second foldable wall, and wherein the set of opposing tabs on the first foldable wall and the set of opposing tabs on the second foldable wall are disposed symmetrically on opposite sides of the center line.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
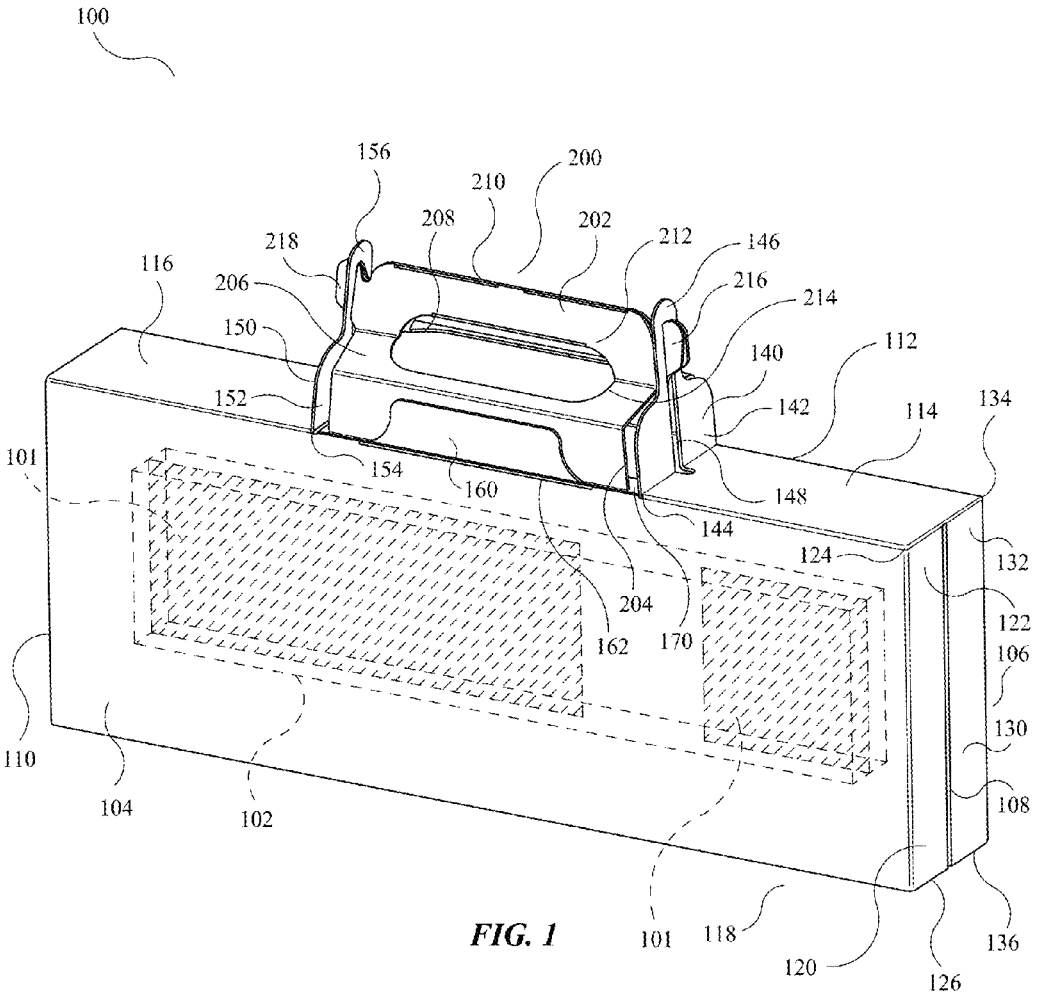
FIG. 1 shows a perspective view of packaging in a closed position and with a retractable handle in an erect position according to an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

The packaging described herein may be used to hold and ship items, such as, for example, consumer products. The packaging may be made of lightweight material, which reduces shipping cost. In some embodiments, the packaging described herein may be made of recyclable and/or biodegradable material that reduces the environmental impact of the packaging. In some embodiments, at least one component of the packaging may be made from a paper-based material, such as cardboard or paperboard.

The packaging described herein may include a retractable handle. The retractable handle may be configured to move between a retracted position and an erect position. In the retracted position, the retractable handle may be concealed, fully or partially, within the packaging. The retraction of the handle within the packaging may reduce the volume of the packaging when the handle is not in use, thereby increasing the number of packages that may fit into a unit volume, thus potentially reducing shipping and/or storage costs. Further, the retraction of the handle may allow the packaging to have a simple geometrical shape (e.g., a cube or a rectangular prism). Simple geometrical shapes may be easier to arrange (e.g., stack) and fit within a unit volume, thereby potentially reducing shipping and/or storage costs.

In the erect position, the retractable handle may define a handgrip. The handgrip may help a user (e.g., consumer or retail employee) carry the packaging. Increased ease in carrying the packaging may reduce the chance of the packaging and/or product within the packaging becoming damaged (e.g., due to the packaging being dropped).

The packaging discussed herein, and components thereof, may be manufactured in a cost-effective and environmentally friendly way. In some embodiments, the packaging described herein may be made using one or more components that are single integrally formed pieces. These single integrally formed pieces may be foldable pieces of material that are folded into shapes and configurations for components of the packaging. The folding of these pieces may create movable components of the packaging. In some embodiments, the foldable material may be a paper-based material. In some embodiments, the foldable material may be a single piece of material that is cut by a single operation (e.g., a single die cutting or laser cutting operation). In some embodiments, the foldable material may be cut from a stock material (e.g., a sheet, board, or roll of material). Single integrally formed pieces of material that are cut by a single cutting operation may facilitate efficient and reproducible manufacturing of the packaging, and components thereof. Moreover, such manufacturing may reduce waste by reducing waste material created during manufacturing.

In some embodiments, the retractable handles discussed herein may be constructed of a single integrally formed piece of material. The single integrally formed piece of material may be a foldable material that folds and unfolds between a retracted position concealed at least partially within the body of packaging and an erect position extending from the body of the packaging.

These and other embodiments are discussed below with reference to the figures. However, those skilled in the art will readily appreciate that the detailed description given herein with respect to these figures is for explanatory purposes only and should not be construed as limiting.

Some embodiments include packaging for transporting and protecting consumer products. Consumer products may be, but are not limited to, electronic devices such as laptops, PCs, televisions, computer screens, phones, multi-media devices, tablets, gaming devices, keyboards, headsets, earphones, cameras, mice, trackpads, remotes, and watches. Consumer products may also include non-electronic device, such as but not limited to clothing, shoes, and kitchenware.

Figure 2:
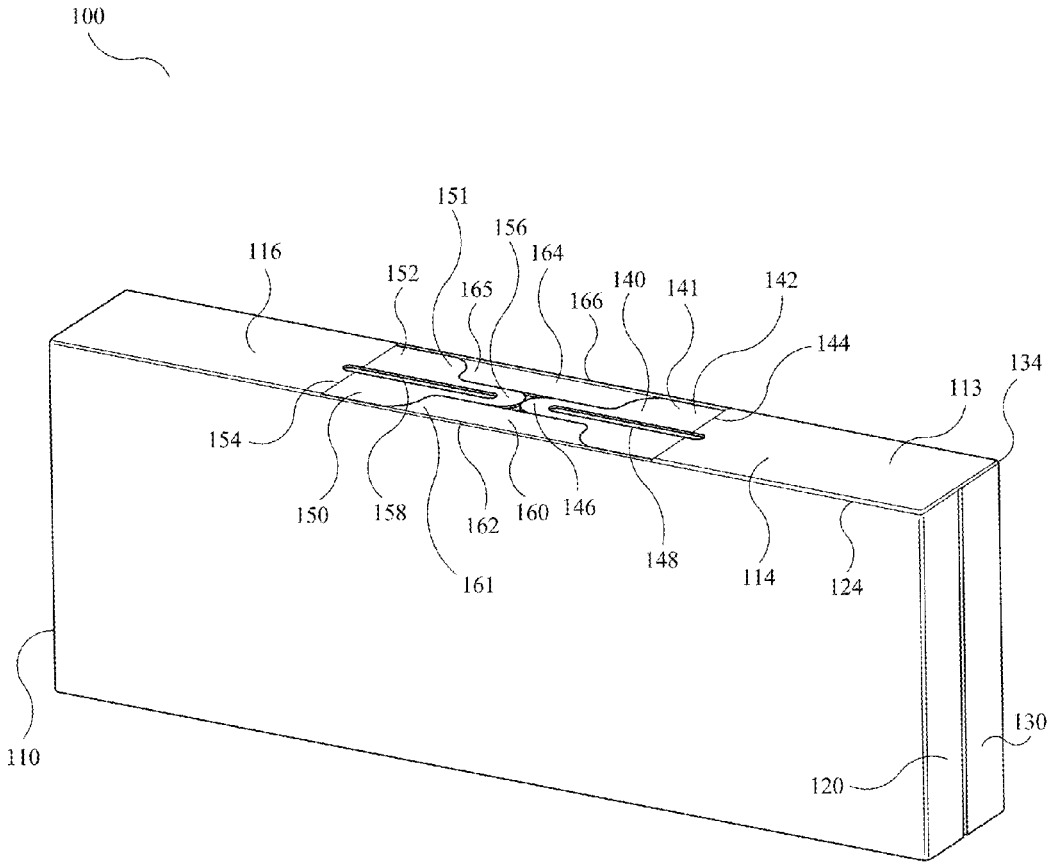
FIG. 2 shows a perspective view of packaging in a closed position and with a retractable handle in a retracted position according to an embodiment.

FIGS. 1 and 2 show packaging 100 according to an embodiment. Packaging 100 may include a packaging body 110 for holding one or more consumer products 101 and a retractable handle 200 coupled to packaging body 110. Retractable handle 200 may include a handgrip 212 at a retractable end 202 of retractable handle 200. In some embodiments, handgrip 212 may include a through hole 214 through which a user can insert his or her fingers when grasping handgrip 212. In some embodiments, handgrip 212 may include one or more cushioning elements for increasing the comfort level of handgrip 212 (see e.g., cushioning elements 840 in FIG. 8). In some embodiments, retractable handle 200 may include opposing tabs 216 and 218 disposed at retractable end 202 of retractable handle 200.

Retractable handle 200 may be configured to reversibly move between an erect position (see e.g., FIG. 1) and a retracted position (see e.g., FIG. 2). In the retracted position, retractable end 202 of retractable handle 200 may be disposed, at least partially, within packaging body 110 of packaging 100. In some embodiments, retractable handle 200 may be entirely disposed within packaging body 110 when in the retracted position. In the erect position, retractable end 202 of retractable handle 200 extends from (e.g., above) packaging body 110 such that it can be grasped by a user. Retractable handle 200 may be configured to retract into and extend from an opening 170 formed in packaging body 110. In some embodiments, opening 170 may be disposed on a spine 112 of packaging body 110.

Figure 4:
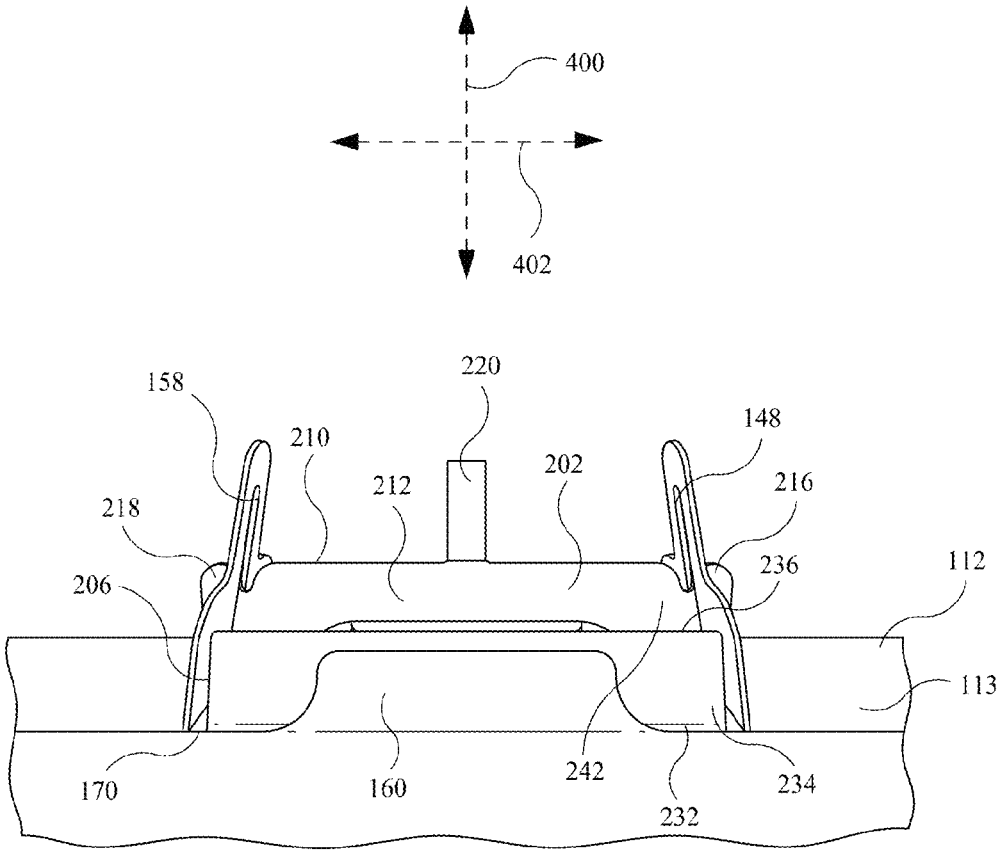
FIG. 4 shows a perspective front view of a retractable handle in a partially erect position according to an embodiment.
Figure 5:
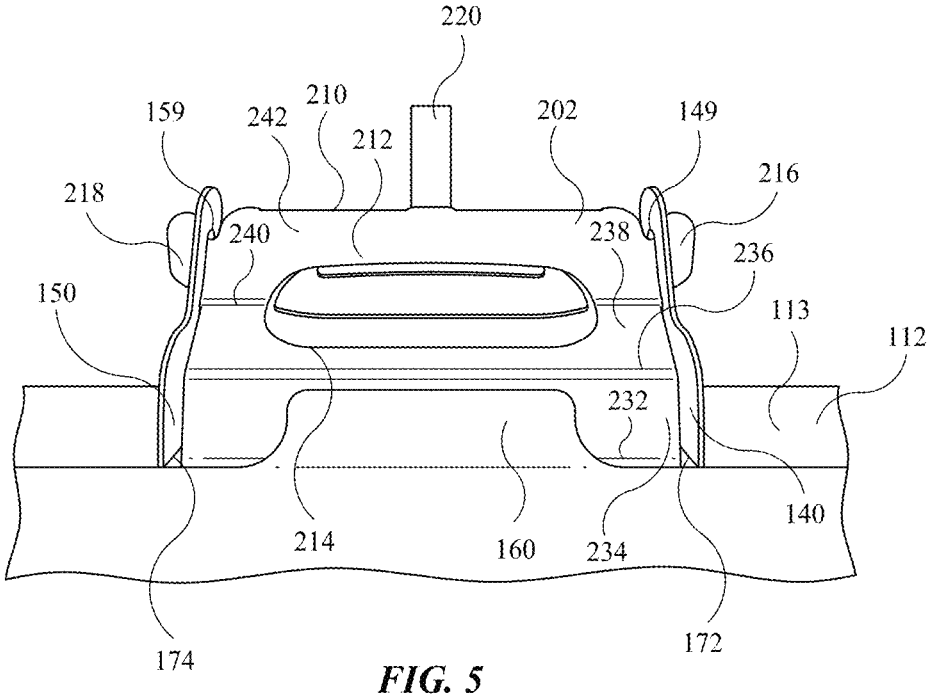
FIG. 5 shows a perspective front view of a retractable handle in an erect position according to an embodiment.

In some embodiments, retractable handle 200 may include a pull tab 220 coupled to retractable end 202 of retractable handle 200 (see e.g. FIGS. 4 and 5). Pull tab 220 may provide a means for allowing a user to pull retractable handle 200 from the retracted position to the erect position. Pull tab 220 may be, but is not limited to, a piece of cloth, a string, or an extension of retractable handle 200 itself.

In some embodiments, retractable handle 200 may be a foldable retractable handle configured to reversibly fold and unfold between the retracted position (see e.g., FIG. 2) and the erect position (see e.g., FIG. 1). In such embodiments, retractable handle 200 may be configured to fold into and unfold from opening 170 on packaging body 110.

Figure 6:
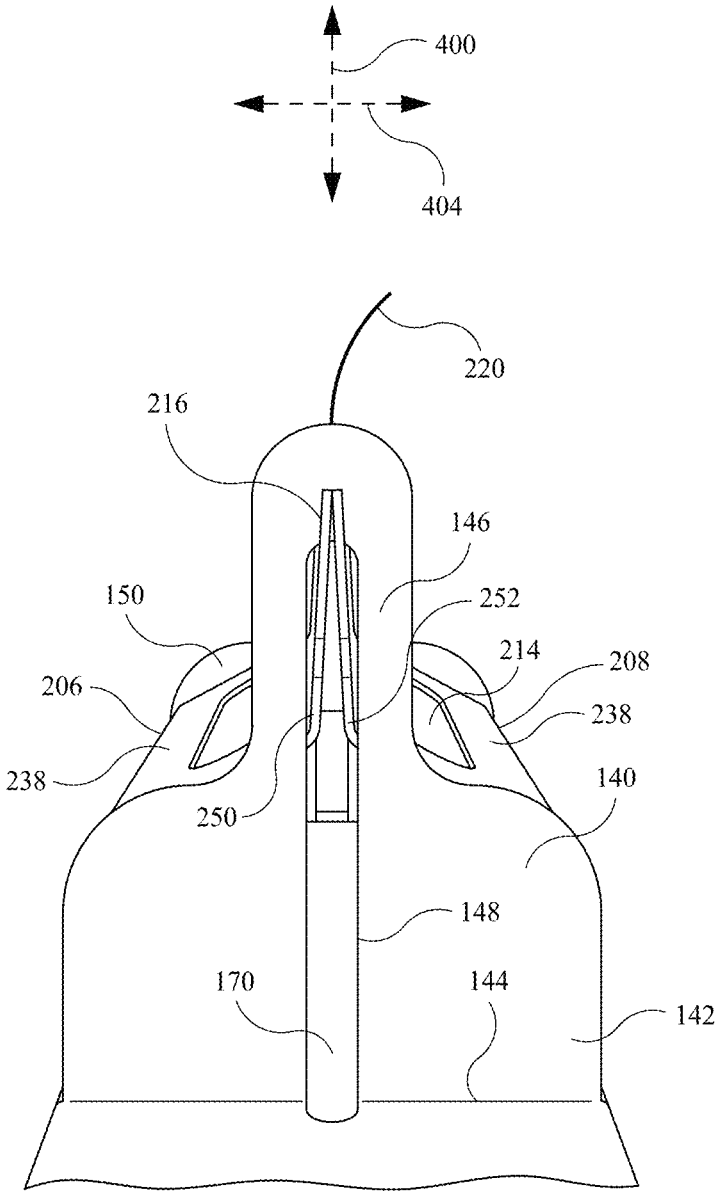
FIG. 6 shows a perspective side view of a retractable handle in an erect position according to an embodiment.

In some embodiments, retractable handle 200 may include a first foldable wall 206 coupled to a second foldable wall 208 at retractable end 202 of retractable handle 200 (see e.g., FIG. 6). First foldable wall 206 may include a fixed end 207 coupled to packaging body 110 (e.g., via an adhesive). In some embodiments, fixed end 207 may be coupled to an internal surface of packaging body 110 (e.g., interior surface 129 shown in FIG. 7A). Similar to first foldable wall 206, second foldable wall 208 may include a fixed end 209 coupled to packaging body 110 (e.g., via an adhesive). In some embodiments, fixed end 209 may be coupled to an internal surface of packaging body 110 (e.g., interior surface 139 shown in FIG. 7A). Together, fixed end 207 of first foldable wall 206 and fixed end 209 of second foldable wall may define an anchored end 204 of retractable handle 200.

First foldable wall 206 may be coupled to second foldable wall 208 via a hinged coupling 210 located at retractable end 202 of retractable handle 200. Hinged coupling 210 may define an uppermost portion (i.e., vertically most disposed portion) of retractable handle 200 when retractable handle 200 is in the erect position. In some embodiments, first foldable wall 206 and second foldable wall 208 may be substantially the same. In some embodiments, first foldable wall 206 and second foldable wall 208 may be a single integrally formed piece of material folded at hinged coupling 210.

In some embodiments, first foldable wall 206 and second foldable wall 208 may be composed of a number of panels hingedly coupled together and configured to allow retractable handle 200 to reversibly fold into and unfold from packaging body 110. For example, as shown in FIGS. 4-7, in some embodiments, first foldable wall 206 and second foldable wall 208 may each include a first panel 230 coupled packaging body 110 and defining the fixed ends 207/209 of the foldable walls 206/208, a second panel 234 hingedly coupled to first panel 230 via a hinged coupling 232, a third panel 238 hingedly coupled to second panel 234 via a hinged coupling 236, and a fourth panel 242 hingedly coupled to third panel 238 via a hinged coupling 240. In such embodiments, fourth panels 242 of foldable walls 206/208 may be coupled together via hinged coupling 210 and define at least a portion of retractable end 202 of retractable handle 200.

In some embodiments, opposing tabs 216 and 218 may be disposed on fourth panels 242 of foldable walls 206/208. In some embodiments, fourth panels 242 of foldable walls 206/208 may define opposing tabs 216 and 218 on retractable handle 200. In some embodiments, opposing tabs 216 and 218 may extend horizontally from the side edges 250 and 252 of foldable walls 206 and 208 in a direction (e.g., horizontal direction 402 in FIG. 4) substantially perpendicular to the direction in which retractable handle 200 folds and unfolds from packaging body 110 (e.g., vertical direction 400 in FIG. 4).

In some embodiments, third panels 238 and fourth panels 242 of foldable walls 206/208 may define handgrip 212 of retractable handle 200. In such embodiments, third panels 238 and fourth panels 242 of foldable walls 206/208 may define through hole 214 of handgrip 212. In some embodiments, through hole 214 may extend through hinged couplings 240 on first foldable walls 206/208.

Hinged couplings 210, 232, 236, and 240 may include, but are not limited to, structurally weakened regions on retractable handle 200. Structurally weakened regions may include, but are not limited to, grooves formed in foldable walls 206 and 208, fold lines, and perforated lines. Grooves may be formed by removing material from a surface of foldable walls 206/208. For example, grooves may be V-shaped or U-shaped grooves formed in a surface of first foldable wall 206 and second foldable wall 208. In some embodiments, fold lines may be formed by removing material from a surface of foldable walls 206/208.

In some embodiments, retractable handle 200 may be composed of one or more a paper-based materials. Suitable paper-based materials include, but are not limited to, cardboard, paperboard, and molded fiber paper. In some embodiments, the cardboard may be corrugated cardboard. In some embodiments, retractable handle 200 may be composed of only paper-based material(s). In some embodiments, retractable handle 200 may be composed of a single piece of paper-based material (e.g., first foldable wall 206 and second foldable wall 208 may be a single piece of foldable paper-based material). In such embodiments, retractable handle 200 may be a piece of foldable paper-based material cut from a piece of source material (e.g. sheet, roll, or board of paper-based material). In some embodiments, the piece of foldable paper-based material may be laminated to increase the strength of retractable handle 200. In some embodiments, lamination may be applied to one or more exterior surfaces of the foldable paper-based material. In some embodiments, layers of foldable paper-based material(s) may be laminated together to form retractable handle 200.

In some embodiments, retractable handle 200, or a portion thereof, may be composed of a polymeric material. Suitable polymeric materials include, but are not limited to, polyethylene, polypropylene, polyurethane, polystyrene. In such embodiments, retractable handle 200 may be a single integrally formed piece of material. In some embodiments, the single integrally formed piece of plastic material may be formed using, for example, injection molding, pressing, and or machining. For example, retractable handle 200 may be an injection molded piece of material. As another example, retractable handle 200 may be a die cut piece of plastic material.

In some embodiments, packaging 100 may include opposing wings 140 and 150 disposed on opposite sides of opening 170 on packaging body 110 (see e.g., FIG. 1). Opposing wings 140 and 150 may be configured to support retractable handle 200 in the erect position. For example, opposing wings 140 and 150 may prevent retractable handle 200 from wobbling when it is in the erect position. In some embodiments, opposing wings 140 and 150 may be configured to guide retractable handle 200 between the retracted position and the erect position. In some embodiments, opposing wings 140 and 150 may be sized and shaped to conceal portions of sides edges 250/252 of foldable walls 206/208 when retractable handle 200 is in the erect position.

Opposing wings 140 and 150 may be hingedly coupled to opposite sides 172 and 174, respectively, of opening 170 (see e.g., FIG. 5). Wing 140 may include a fixed end 142 hingedly coupled to packaging body 110 and a free end 146 disposed opposite fixed end 142. Fixed end 142 may be hingedly coupled to packaging body 110 via a hinged coupling 144. Similar to wing 140, wing 150 may include a fixed end 152 hingedly coupled to packaging body 110 and a free end 156 disposed opposite fixed end 152. Fixed end 152 may be hingedly coupled to packaging body 110 via a hinged coupling 154. In some embodiments, opposing wings 140 and 150 may be the same (e.g., may be mirror images of each other disposed on opposite sides of opening 170 on packaging body 110). In some embodiments, wings 140 and 150 may be integrally formed with packaging body 110 (e.g., integrally formed with spine 112 of packaging body 110). In some embodiments, wings 140/150 may be coupled to opposing peripheral portions 114 and 116 of spine 112 via hinged couplings 144/154.

Hinged couplings 144 and 154 may include, but are not limited to, structurally weakened regions on packaging body 110. Structurally weakened regions may include, but are not limited to, grooves formed in a wall of packaging body 110, fold lines, and perforated lines. Grooves may be formed by removing material from a surface of packaging body 110. For example, grooves may be V-shaped or U-shaped grooves formed in a surface of packaging body 110. In some embodiments, fold lines may be formed by removing material from a surface of packaging body 110.

In operation, wings 140 and 150 may be configured to rotate away from packaging body 110 and towards opposite sides of packaging body 110 (e.g., upward and outward) in opposite rotational directions so as to open and close opening 170. For example, FIG. 1 shows wings 140 and 150 both in an open position and FIG. 2 shows wings 140 and 150 both in a closed position. In the closed position, wings 140 and 150 may serve to conceal retractable handle 200 from view. In the open position, wings 140 and 150 may support retractable handle 200 in its erect position.

Wings 140 and 150 may be configured to partially cover opening 170 when wings 140 and 150 are in their closed positions (see e.g., FIG. 2). In some embodiments, wing 140 and wing 150 may, together, completely cover opening 170 when they are both in their closed positions. In some embodiments, wings 140 and 150 may define a portion of the part of packaging body 110 to which they are hingedly coupled when in the closed position (e.g., wings 140/150 may define a portion of spine 112 when in the closed position). In some embodiments, the top surfaces 141 and 151 of wings 140 and 150 may be flush with the surface of packaging body 110 to which wings 140/150 are hingedly coupled. For example, top surfaces 141 and 151 may be flush with an exterior surface 113 of spine 112. As used herein, "flush" refers to two or more surfaces (e.g., top surfaces 141/151 of wings 140/150 and a surface of packaging body 110) sharing the same geometric plane, at least at their edges. In some embodiments, the flush surfaces may be flush within a deviation of +/−1/16of an inch, which is generally imperceptible to a casual observer and will appear as a smooth, flat surface.

Wing 140 may include a slot 148 and wing 150 may include a slot 158. Slot 148 may extend from fixed end 142 of wing 140 to free end 146 of wing 140. Similarly, slot 158 may extend from fixed end 152 of wing 150 to free end 156 of wing 150. In some embodiments, slots 148 and 158 may be the same (i.e., have the same dimensions and location on their respective wings). In some embodiments, slots 148/158 may be through holes formed in (e.g., cut from) wings 140/150. In some embodiments, slots 148/158 may be recesses formed in wings 140/150. In some embodiments, slots 148 and 158 may extend from wings 140 and 150 through hinged couplings 144 and 154 and onto the part of packaging body 110 to which the wings 140/150 are hingedly coupled (e.g., spine 112). For example, as shown in FIG. 2, slot 148 may extend from wing 140 onto peripheral portion 114 of spine 112 and slot 158 may extend from wing 150 onto peripheral portion 116 of spine 112.

Slots 148 and 158 may be configured (e.g., sized and shaped) to cooperate with opposing tabs 216 and 218 disposed on retractable handle 200. In some embodiments, tabs 216 and 218 may be configured to slide within slots 148 and 158, respectively, as retractable handle 200 is moving between the retracted position and the erect position. In some embodiments, tabs 216 and 218 may be configured to extend through slots 148 and 158. In some embodiments, tabs 216 and 218 may be configured to engage upper ends 149 and 159 of slots 148 and 158 when retractable handle 200 is in the erect position. In such embodiments, upper ends 149 and 159 may serve to limit the extension of retractable handle 200 from packaging body and prevent retractable handle 200 from extending past a predetermined position (i.e., the erect position). In some embodiments, engagement between upper ends 149 and 159 and tabs 216 and 218 may help hold retractable handle 200 in the erect position.

In some embodiments, packaging 100 may include one or more flaps (e.g., flaps 160 and 164) configured to open and close at least a portion of opening 170. Flaps 160 and 164 may be hingedly coupled to a portion of packaging body 110 around a portion of opening 170 via hinged couplings 162 and 166, respectively. Similar to wings 140/150, flaps 160/164 may be configured to partially cover opening 170 when they are in a closed position (see e.g., FIG. 2). In some embodiments, flaps 160 and 164 may be configured to rotate away from packaging body 110 and towards opposite sides of packaging body 110 (e.g., upward and outward) in opposite rotational directions so as to open and close opening 170. In some embodiments, the top surfaces 161 and 165 of flaps 160 and 164 may be flush with top surfaces 141 and 151 of wings 140 and 150 when wings 140/150 and flaps 160/164 are both in a closed position. In some embodiments, wings 140/150 and flaps 160/164 may, together, completely cover opening 170 when they are all in their closed positions. In some embodiments, a low tact adhesive may be used to hold wings 140/150 and/or flaps 160/164 in their closed position.

Packaging body 110 may be sized and shaped to house one or more consumer products 101. In some embodiments, as shown for example in FIG. 1, packaging body 110 may include a first section 120 and a second section 130 both coupled to spine 112. In such embodiments, spine 112 may serve as the closed end of packaging 100 that does not allow convenient access to the consumer product(s) 101 within packaging 100. In some embodiments, first section 120 may include a fixed end 122 hingedly coupled to spine 112 via a hinged coupling 124 and a free end 126 disposed opposite fixed end 122. Similarly, second section 130 may include a fixed end 132 hingedly coupled to spine 112 via a hinged coupling 134 and a free end 136 disposed opposite fixed end 132. Free ends 126 and 136 may define an openable end 118 of packaging 100 that allows convenient access to consumer product(s) 101 within packaging 100. Hinged couplings 124 and 134 may be the same as or similar to hinged couplings 144 and 154. Second section 130 and first section 120 may define a front wall 104 and a back wall 106 of packaging 100. Together, spine 112, first section 120, and second section 130 may define a perimeter wall 108 of packaging 100.

In some embodiments, first section 120 and second section 130 may be configured to rotate relative to each other (i.e., away from and towards each other) between an open position (see e.g., FIG. 7A) and a closed position (see e.g., FIG. 1) to open and close packaging 100. In some embodiments, only one of first section 120 and second section 130 may be hingedly coupled to spine 112. In such embodiments, the section hingedly coupled to spine 112 may be configured to rotate in order to open and close packaging 100 while the other section remains stationary relative to spine 112.

In some embodiments, packaging body 110 may be composed of one or more a paper-based materials. Suitable paper based materials include, but are not limited to, cardboard, paperboard, and molded fiber paper. In some embodiments, the cardboard may be corrugated cardboard. In some embodiments, packaging body 110 may be composed of only paper-based material(s). In some embodiments, packaging body 110 may be composed of a single piece of foldable paper-based material. In such embodiments, packaging body 110 may be a single piece of foldable paper-based material cut from a piece of source material (e.g. sheet, roll, or board of paper-based material). In some embodiments, the piece of foldable paper-based material may be laminated, in whole or in part, to increase the strength of packaging body 110. For example, spine 112 and wings 140/150 may include surface lamination to increase the strength of packaging body 110 at points where the weight of packaging body 110 and product(s) 101 housed within packaging body 110 will rest when packaging 100 is being carried via retractable handle 200.

In some embodiments, packaging body 110, or a portion thereof, may be composed of a polymeric material. Suitable polymeric materials include, but are not limited to, polyethylene, polypropylene, polyurethane, polystyrene. In some embodiments, the single integrally formed piece of plastic material may be folded into the shape of packaging body 110. In some embodiments, the single integrally formed piece of plastic material may be formed using, for example, injection molding, pressing, and or machining.

In some embodiments, packaging body 110 and retractable handle 200 may be made of the same material. In some embodiments, packaging body 110 and retractable handle 200 may be made of a different material. In some embodiments, packaging body 110 and retractable handle 200 may be the same color. In some embodiments, packaging body 110 and retractable handle 200 may be different colors.

While FIGS. 1 and 2 show opening 170 disposed on spine 112 and retractable handle 200 configured to extend from spine 112, opening 170 may be disposed on other walls of packaging body 110, such as front wall 104 or back wall 106, and retractable handle 200 may be configured to extend from that wall.

Figure 3:
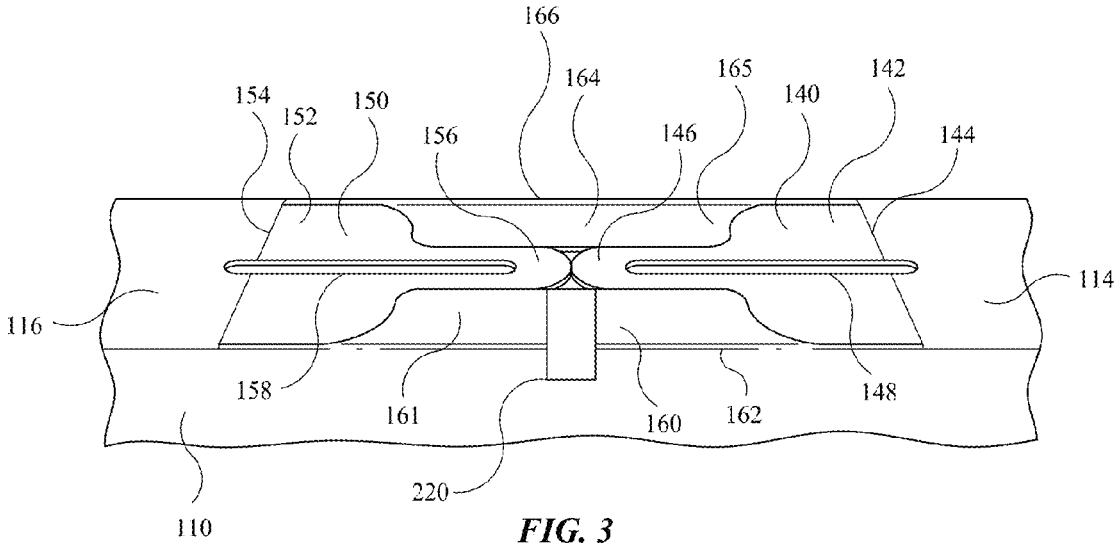
FIG. 3 shows a perspective front view of a retractable handle in a retracted position according to an embodiment.

FIGS. 3-5 show the movement of retractable handle 200 between a retracted position (FIG. 3) and an erect position (FIG. 5) according to an embodiment. As shown in FIG. 3, retractable handle 200 may be concealed within packaging body 110 when in the retracted position. In such embodiments, wings 140/150 and flaps 160/164 may hide retractable handle 200 from view, with the exception of pull tab 220. Pull tab 220 may extend from between wings 140/150 and flaps 160/164 and allow a user to pull retractable handle 200 from the retracted position to the erect position. For example, a user may pull pull tab 220 upward in vertical direction 400 to move retractable handle 200 from the retracted position towards, and ultimately to, the erect position.

FIG. 4 shows retractable handle 200 in a partially erect position above packaging body 110. As shown in FIG. 4, the movement of retractable handle 200 towards the erect position may cause wings 140/150 and flaps 160/164 to rotate from their closed positions towards their open positions. Wings 140/150 may rotate in an upward direction (i.e., upward in vertical direction 400) and outward direction (i.e., in opposite horizontal directions along first horizontal direction 402). Flaps 160/164 may rotate in an upward direction (i.e., upward in vertical direction 400) and outward direction (i.e., in opposite horizontal directions along second horizontal direction 404 (see e.g., FIG. 6)). As retractable handle 200 begins moving from the retracted position towards the erect position, tabs 216 and 218 may engage and begin to slide within slots 148 and 158 on wings 140 and 150, respectively. The engagement between tabs 216/218 and slots 148/158 may be facilitated by the portion of slots 148/158 that are disposed on peripheral portions 114/116 of spine 112.

As retractable handle 200 moves towards the erect position, second panels 234 of first foldable wall 206 and second foldable wall 208 may be begin to rotate about hinged couplings 232 in an upward direction (i.e., upward in vertical direction 400) and an outward direction (i.e., in opposite horizontal directions along second horizontal direction 404). At the same time, third panels 238 of first foldable wall 206 and second foldable wall 208 may begin to rotate about hinged couplings 236 in upward direction (i.e., upward in vertical direction 400) and outward direction (i.e., in opposite horizontal directions along second horizontal direction 404) as they emerge from opening 170. In other words, second panel 234 and third panel 238 of first foldable wall 206 may rotate in the same rotational direction (e.g., counter-clockwise) while second panel 234 and third panel 238 of second foldable wall 208 rotate in the same rotational direction in the opposite direction (e.g., clockwise).

As illustrated in FIGS. 4 and 5, third panels 238 may be oriented in a downward position (i.e., pointing towards the interior of packaging body 110) when retractable handle 200 is in the retracted position. As retractable handle 200 moves from the retracted position to the erect position, third panels 238 may rotate from this downward orientation, to an orientation that is parallel to exterior surface 113 of spine 112, and into an upward-oriented position (i.e., pointing away from the interior of packaging body 110). In some embodiments, this movement of third panels 238 may serve to bias retractable handle 200 in the retracted position.

Third panels 238 may bias retractable handle 200 in the retracted position by resisting movement into a predetermined position. In some embodiments, third panels 238 of foldable walls 206/208 may be configured to bias retractable handle 200 in the retracted position until third panels 238 are moved past a predetermined position. In some embodiments, this predetermined position may be substantially perpendicular to first internal surface 129 and/or second internal surface 139 of packaging body 110. In some embodiments, this predetermined position may be substantially parallel to exterior surface 113 of spine 112. In some embodiments, third panels 238 of foldable walls 206/208 may be configured to bias retractable handle 200 in the retracted position until retractable handle 200 is moved a predetermined amount from the retracted position towards the erect position. In some embodiments, this predetermined amount may be greater than 50% (i.e., greater than half way between the retracted position and the erect position). In some embodiments, a movement of retractable handle 200 50% from the retracted position to the erect position may be the equivalent of third panels 238 moving into a position that is substantially perpendicular to internal surfaces 129/139 (and/or substantially parallel to exterior surface 113). Once third panels 238 are moved past the predetermined position, retractable handle 200 may spring towards the erect position (e.g., as shown in FIG. 5).

As second panels 234 and third panels 238 are rotating upward and outward, fourth panels 242 of retractable handle 200 may rotate about hinged coupling 210 in an inward direction (i.e., opposite directions along second horizontal direction 404) and a downward direction (i.e., downward in vertical direction 400). In other words, fourth panels 242 of first foldable wall 206 and second foldable wall 208 may rotate downward in opposite rotational directions towards each other as retractable handle 200 moves upward towards the erect position.

In some embodiments, slots 148/158 may serve as stops for the movement of retractable handle 200 and define the location and configuration of retractable handle 200 in the erect position. In such embodiments, when tabs 216/218 engage upper ends 149/159 of slots 148/158, retractable handle 200 has reached the erect position (see e.g., FIG. 5). During the movement of retractable handle 200, first panels 230 of first foldable wall 206 and second foldable wall 208 may remain stationary on packaging body 110.

As shown in FIG. 5, wings 140/150 may be oriented in a vertical direction substantially perpendicular to exterior surface 113 of spine 112 when retractable handle 200 is in the erect position. This position of wings 140/150 may be their open position. In such embodiments, as least a portion of slots 148/158 may extend substantially perpendicular to exterior surface 113 of spine when wings 140/150 are in their open position. In some embodiments, flaps 160/164 may oriented in a vertical direction substantially perpendicular to exterior surface 113 of spine when retractable handle 200 is in the erect position. This position of flaps

160/164 may be their open position. In some embodiments, second panels 234 of foldable walls 206/208 may be oriented in a vertical position substantially perpendicular to exterior surface 113 of spine 112 when retractable handle 200 is in the erect position.

While the order of FIGS. 3-5 shows the movement of retractable handle 200 from the retracted position to the erect position, the movement of retractable handle 200 from the erect position to the retraced position, as well as the movement of wings 140/150 and flaps 160/164 from their open positions to their closed positions, is shown when viewing FIGS. 3-5 in reverse order. In some embodiments, third panels 238 of foldable walls 206 and 208 may bias retractable handle in the erect position until retractable handle 200 is pushed downward a predetermined amount and/or until third panels 238 reach a predetermined position.

Figure 7A:
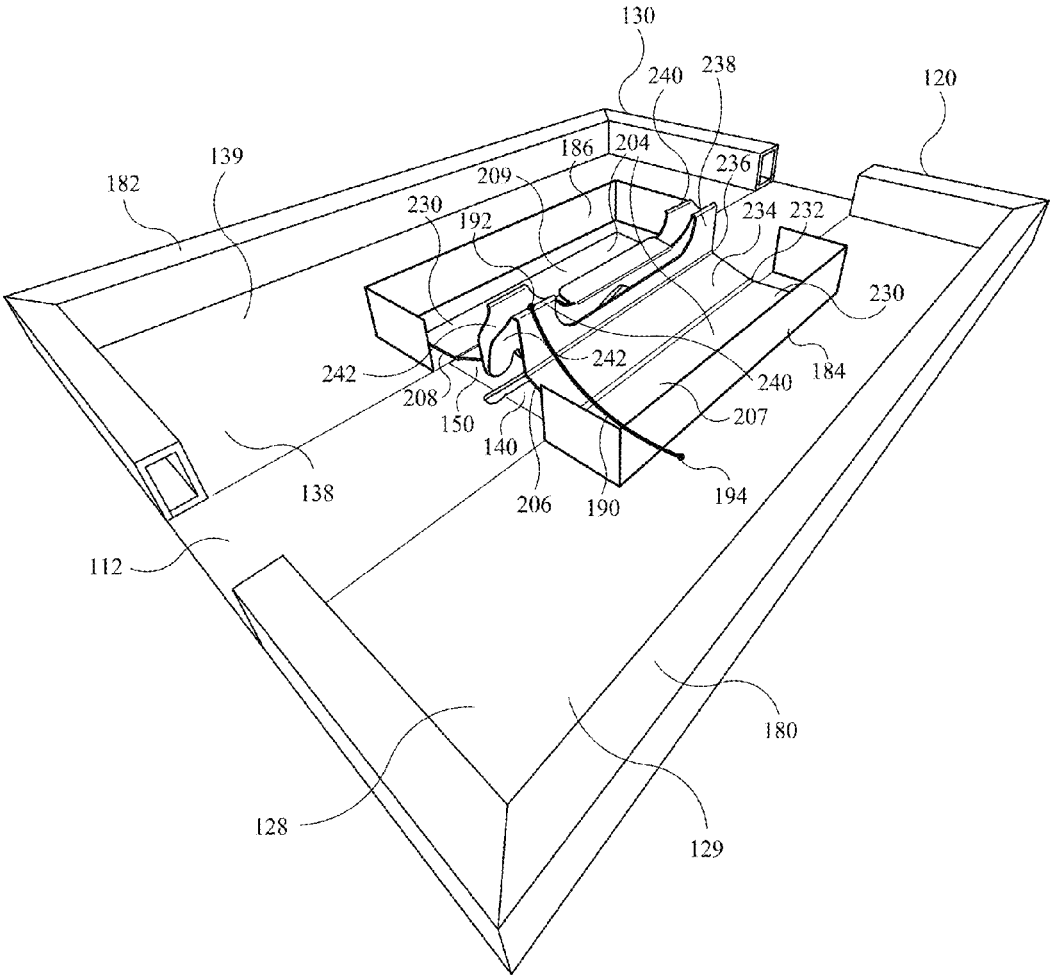
FIG. 7A shows a perspective view of packaging in an open position according to an embodiment.

FIG. 7A shows packaging 100 according to an embodiment in an open position with the interior of packaging 100 exposed. FIG. 7A also shows retractable handle 200 in a retracted position within packaging body 110. As shown in FIG. 7A, first section 120 may define first internal surface 129 of packaging body 110 and second section 130 may define second internal surface 139 of packaging body 110. In some embodiments, first section 120 of packaging body 110 may include a first cavity 128 defined by first internal surface 129 and a frame 180 disposed along at least a portion of the perimeter of first section 120. In some embodiments, second section 130 of packaging body 110 may include a second cavity 138 defined by second internal surface 139 and a frame 182 disposed along at least a portion of the perimeter of second section 130. First cavity 128 and/or second cavity 138 may define product cavity 102 for holding product(s) 101 within packaging 100. In some embodiments, a packaging insert may be disposed in first cavity 128 and/or second cavity 138 for holding product(s) within packaging 100. For example, packaging 100 may include a packaging insert disclosed in U.S. application Ser. No. 14/318,011, filed on Jun. 27, 2014, which is incorporated herein in its entirety by reference thereto.

When packaging 100 is in the closed position (see e.g., FIG. 1), first cavity 128 and/or second cavity 138 may define a closed product cavity 102. In some embodiments, packaging body 110 may include internal frame sections 184 and 186 disposed around at least a portion of fixed ends 207 and 209 of first foldable wall 206 and second foldable wall 208. In such embodiments, internal frame sections 184 and 186 may prevent contamination (e.g., debris and/or liquid) from entering product cavity 102 via opening 170 when packaging body 110 is in the closed position. In some embodiments, frame 180, frame 182, and/or frame sections 184/186 may be hollow shafts. Hollow shafts may provide shock resistance and cushioning for packaging body 110 and protect product(s) 101 housed within packaging body 110. In some embodiments, the hollow shafts may be filled with a shock absorbing material, such as but not limited to a foam.

In some embodiments, packaging 100 may include a cord 190 having a first end 192 coupled to retractable handle 200 and a second end 194 coupled to first internal surface 129 of packaging body 110. In such embodiments, cord 190 may be configured to bias retractable handle 200 in the retracted position when first section 120 is in the open position. In operation, cord 190 may be configured to pull retractable handle 200 into the retracted position (if it is not already in the retracted position) when first section 120 is rotated into its open position. In embodiments including cord 190, cord 190 may have a length and/or may be anchored to first internal surface 129 such that rotating first section 120 to its open position causes cord 190 to pull retractable handle 200 into opening 170. Cord 190 will pull on retractable handle 200 because the relative distance between internal surface 129 and retractable handle 200 increases as first section 120 is rotated to its open position. In some embodiments, second end 194 of cord 190 may be coupled to second internal surface 139. In such embodiments, cord 190 may be configured to bias retractable handle 200 in the retracted position when second section 130 is in its open position. In some embodiments, packaging 100 may include a two cords 190, one coupled to retractable handle 200 and first internal surface 129 and one coupled to retractable handle 200 and second internal surface 139. In such embodiments, the rotation of either first section 120 or second section 130 may cause retractable handle 200 to move into the retracted position (if it is not already in the retracted position).

Figure 8:
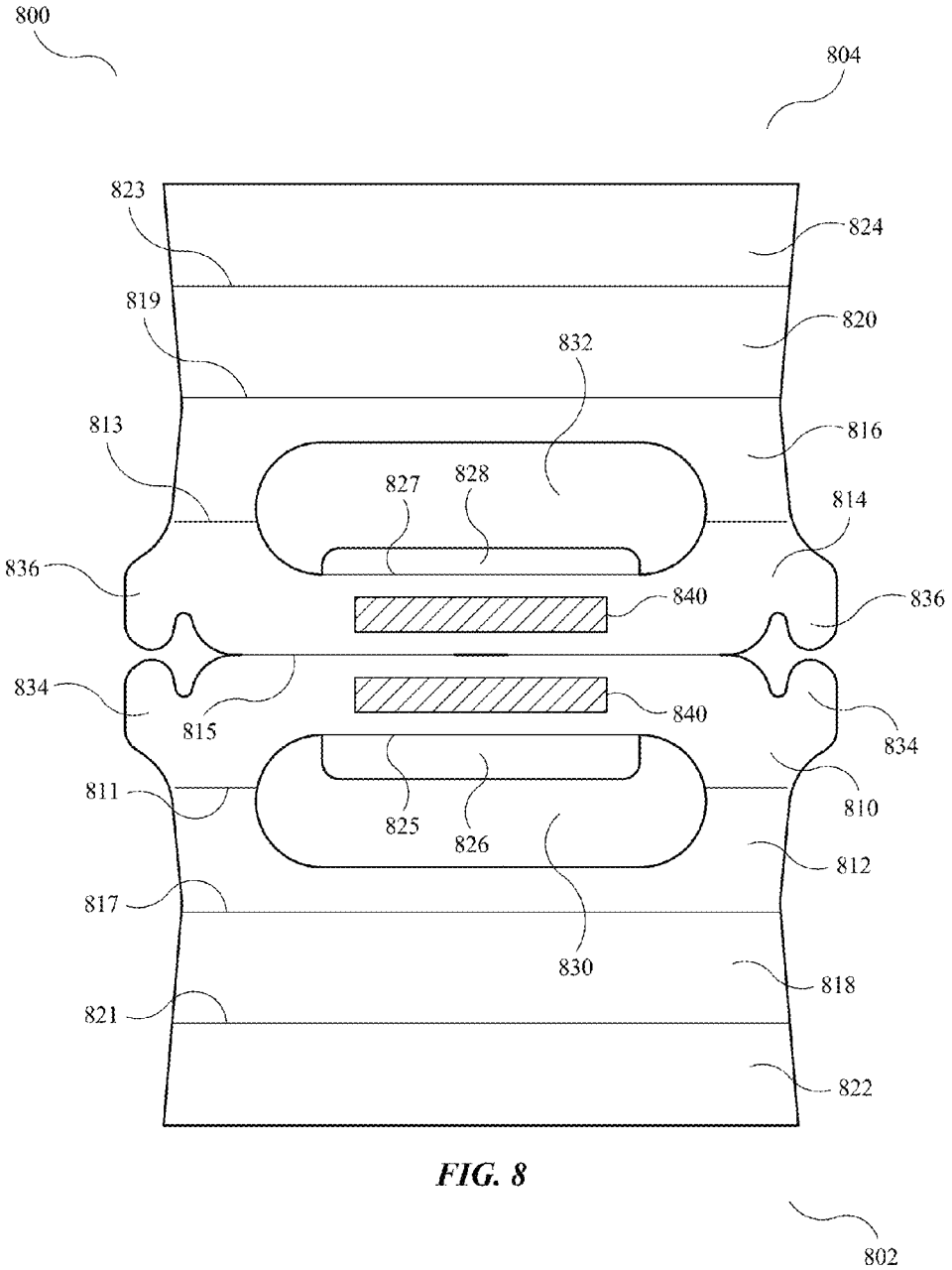
FIG. 8 shows a retractable handle blank according to an embodiment.

FIG. 8 shows a retractable handle blank 800 for forming retractable handle 200 according to an embodiment. Retractable handle blank 800 may include a first handle wall 802 having a first panel 810 connected to a second panel 812 by a downward fold line 811. First panel 810 may include a first set of tabs 834 on opposing side edges of first panel 810. In some embodiments, first handle wall 802 may include a first through hole 830 formed in first panel 810 and second panel 812. Retractable handle blank 800 may also include a second handle wall 804 including a third panel 814 connected to a fourth panel 816 by a downward fold line 813. Third panel 814 may include a second set of tabs 836 on opposing side edges of third panel 814. In some embodiments, second handle wall 804 may include a second through hole 832 formed in third panel 814 and fourth panel 816. First handle wall 802 and second handle wall 804 may define first foldable wall 206 and second foldable wall 808 of retractable handle 200. The sets of tabs 834 and 836 may define tabs 216 and 218 when retractable handle blank 800 is folded into retractable handle 200.

As used herein, the term "upward fold line" means a fold line that allows a component (e.g., panel) of a foldable piece of material (e.g., retractable handle blank 800) to fold upward out of the page. Similarly as used herein, the term "downward fold line" means a fold line that allows a component of a foldable piece of material to fold into the page.

Figure 7B:
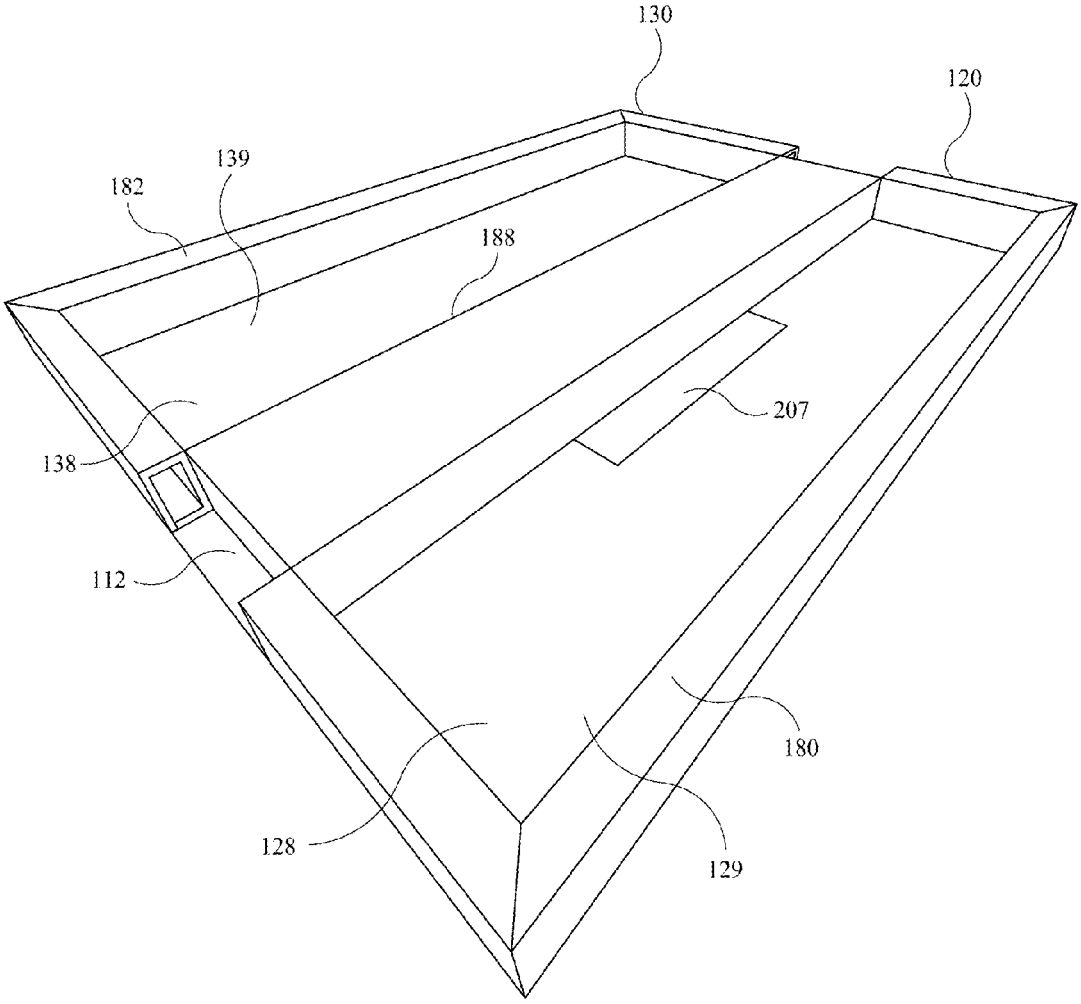
FIG. 7B shows a perspective view of packaging in an open position according to another embodiment.

FIG. 7B shows packaging 100 according to an embodiment in an open position with the interior of packaging 100 exposed. As shown in FIG. 7B, in some embodiments, packaging 100 may include an internal compartment 188 for housing retractable handle 200 when retractable handle 200 is in its retracted position. Internal compartment 188 may be a hollow compartment coupled to spine 112 and disposed over retractable handle 200 within packaging body 110. Internal compartment 188 may conceal retractable handle 200 from view when packaging 100 is in an open position, and may provide additional support at the periphery of packaging 100 when packaging 100 is closed around an item. Internal compartment 188 may be sized and shaped such that it does not interfere with the rotational movement of first section 120 and/or second section 130. In some embodiments, internal compartment 188 may be sized and shaped to house the entirety of retractable handle 200 with the exception of fixed ends 207/209 of foldable walls 206/208. Alternatively, in some embodiments, internal compartment 188 may be sized and shaped to house the entirety of retractable handle 200 including fixed ends 207/209 of foldable walls 206/208. In such an embodiment fixed ends 207/209 of foldable walls 206/208 may be coupled to an internal surface of internal compartment 188.

Internal compartment 188 may prevent contamination (e.g., debris and/or liquid) from entering product cavity 102 via opening 170 on packaging body 110. In some embodiments, internal compartment 188 may provide shock resistance and cushioning for packaging body 110 and protect product(s) 101 housed within packaging body 110. In some embodiments, a portion of the space within internal cavity 188 may be filled with a shock absorbing material, such as but not limited to a foam. In some embodiments, the space within internal cavity 188 may be empty, to provide airspace cushioning.

As shown in FIG. 8, first panel 810 may be connected to third panel 814 by an upward fold line 815. First panel 810, second panel 812, third panel 814, and fourth panel 816 may define fourth panels 242 and third panels 238 of foldable walls 206/208 of retractable handle 200. When folded into retractable handle 200, first panel 810, third panel 814, first through hole 830, and second through hole 832 may be configured to form handgrip 212 of retractable handle 200. In some embodiments, fold lines 811, 813, and 815 may be parallel to each other on retractable handle blank 800. The opposite folding direction of fold lines 811 and 813 (downward) and fold line 815 (upward) may facilitate folding of retractable handle 200 into and out of opening 170 on packaging body 110.

In some embodiments, retractable handle blank 800 may include a fifth panel 818 connected to second panel 812 by an upward fold line 817 and a sixth panel 820 connected to fourth panel 816 by an upward fold line 819. Fifth panel 818 and sixth panel 820 may define second panels 834 of foldable walls 206/208 of retractable handle 200. The opposite folding direction of fold lines 811 and 813 (downward) and fold lines 817 and 819 (upward) may facilitate folding of retractable handle 200 into and out of opening 170 on packaging body 110. The opposite folding direction of these fold lines may also create the biased nature of retractable handle 200 created by third panels 238 of first and second foldable walls 206/208.

In some embodiments, retractable handle blank 800 may include a seventh panel 822 connected to fifth panel 818 by an upward fold line 821 and an eighth panel 824 connected to sixth panel 820 by an upward fold line 823. Seventh panel 822 and eighth panel 824 may define first panels 230 of foldable walls 206/208 of foldable handle 200. The same folding direction of fold lines 817 and 819 (upward) and fold lines 821 and 823 (upward) may facilitate folding of retractable handle 200 into and out of opening 170 on packaging body 110.

In some embodiments, first handle wall 802 may be substantially the same as second handle wall 804. In some embodiments, upward fold line 815 may located at a center line of retractable handle blank 800. In some embodiments, first handle wall 802 and second handle wall 804 may have bilateral symmetry about upward fold line 815. In some embodiments, first set of tabs 834 and second set of tabs 836 may be disposed on opposite sides of upward fold line 815 and may have bilateral symmetry about upward fold line 815. In some embodiments, first panel 810 and third panel 814 may have bilateral symmetry about upward fold line 815. In some embodiments, first through hole 830 and second through hole 832 may be disposed symmetrically on opposite sides of upward fold line 815.

In some embodiments, first handle wall 802 may include a ninth panel 826 disposed within first through hole 830 and connected to first panel 810 via an upward fold line 825. In some embodiments, second handle wall 804 may include a tenth panel 828 disposed within second through hole 832 and connected to third panel 814 via an upward fold line 827. In embodiments including ninth panel 826 and tenth panel 828, these panels may fold so as to at least partially overlap to form a triangular shape with first panel 810 and third panel 814 at retractable end 202 of retractable handle 200. In such embodiments, this triangular shape may serve to disperse the weight of packaging 100 and the product(s) 101 housed within packaging body 110 across a larger surface area on a user's hand, thereby increasing the comfort level for handgrip 212.

In embodiments including cushioning at retractable end 202 of retractable handle 200, one or more cushioning elements 840 may be disposed on first panel 810 between upward fold line 825 and upward fold line 815. Similarly, one or more cushioning elements 840 may be disposed on panel 814 between upward fold line 827 and upward fold line 815. Cushioning elements 840 may be but are not limited to foam elements.

Figure 9:
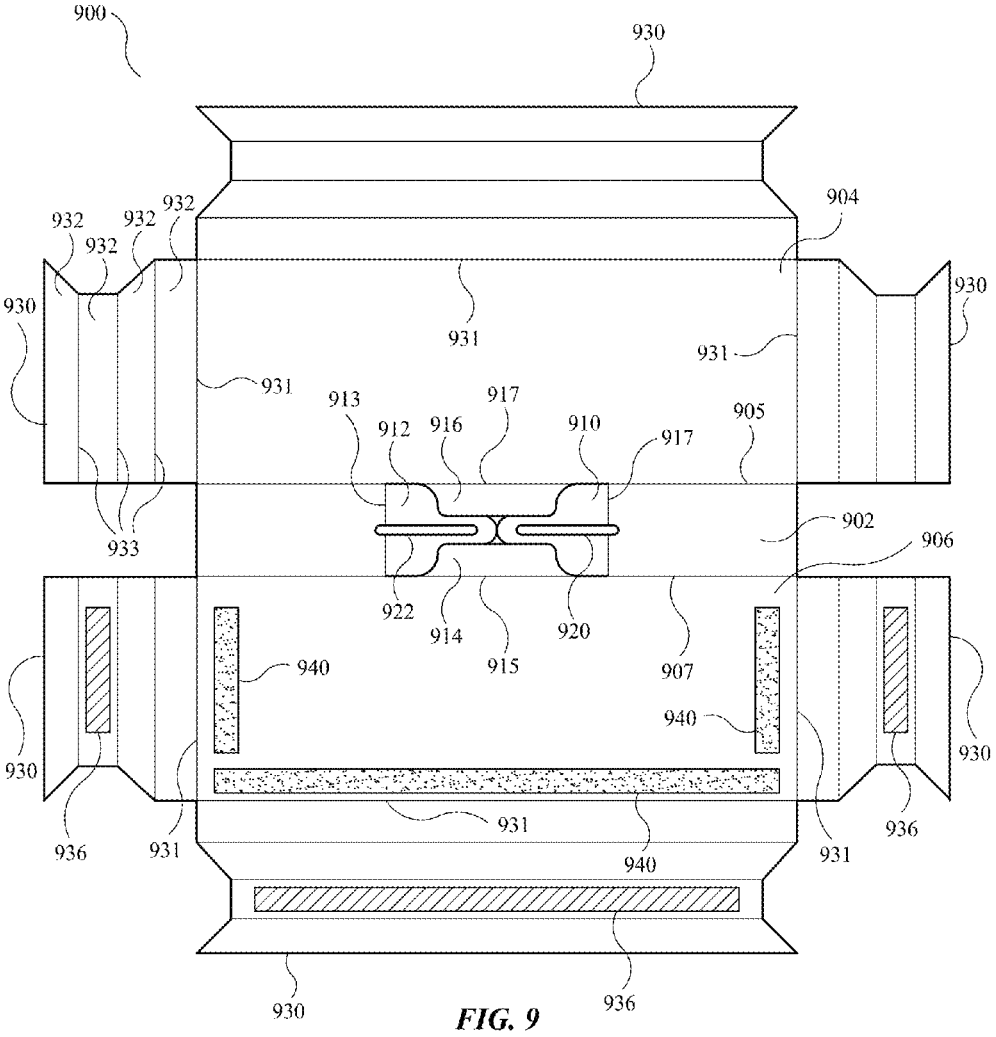
FIG. 9 shows a packaging blank according to an embodiment.

FIG. 9 shows a packaging blank 900 for forming packaging body 110 according to an embodiment. Packaging blank 900 may include a spine 902 connected to a first section 904 along a first side of spine 902 by an upward fold line 905 and connected to a second section 906 along a second, opposite side of spine 902 by an upward fold line 907. Packaging blank 900 may include a pair of opposing wings 910 and 912 connected to spine 902 between upward fold lines 905 and 907 by downward fold lines 911 and 913, respectively. In some embodiments, packaging blank 900 may include a pair of opposing flaps 914 and 916 connected to spine 902. In such embodiments, flap 914 may be connected to the first side of spine 902 by a downward fold line 915 and flap 916 may be connected to the second side of spine 902 by a downward fold line 917.

As shown in FIG. 9, packaging blank 900 may include a first slot 920 and a second slot 922 formed in spine 902. First and second slots 920 and 922 may define slots 148 and 158, respectively, on packaging body 110. In some embodiments, first and second slots 920 and 922 may be through holes cut in packaging blank 900.

In some embodiments, packaging blank 900 may include a plurality of frame sections 930 connected to the perimeter sides of first section 904 and second section 906 by upward fold lines 931. Frame sections 930 may include a set of panels 932 configured to fold about a set of upward fold lines 933 and upward fold line 931 into a hollow polygonal shape (e.g., a square shape) to form portions of frames 180 and 182 of packaging body 110. In embodiments including cushioning in frames 180/182, one or more cushioning elements 936 may be disposed on one or more panels 932. Cushioning elements 936 may be but are not limited to foam elements. Frame sections 930 folded into portions of frames 180/182 may be coupled to first section 904 and second section 906 via attachment mechanisms 940 disposed on first section 904 and second section 906. Attachment mechanisms 940 may be but are not limited to an adhesive or a double-sided tape.

In some embodiments, retractable handle blank 800 and packaging blank 900 may be assembled to form packaging 100. In some embodiments, packaging blank 900, and components thereof (e.g., wings 910/912 and flaps 914/916), may be cut from a paper-based material. In some embodiments, the cutting of packaging blank 900 may include forming fold lines on packaging blank 900 (e.g., by removing material from the surface of packaging blank 900 or otherwise structurally weakening areas on packaging blank 900 corresponding to the location of the fold lines on packaging blank 900).

In some embodiments, retractable handle blank 800, and components thereof (e.g., first handle wall 802, second handle wall 804, tabs 834/836, and through holes 830/832), may be cut from a paper-based material. In some embodiments, the cutting of retractable handle blank 800 may include forming fold lines on retractable handle blank 800. Fold lines on retractable handle blank 800 may be formed in the same fashion as those formed on packaging blank 900.

When assembling packaging 100, retractable handle blank 800 may be pre-folded along its fold lines into a shape corresponding to its retracted position and coupled to first section 904 and second section 906 on packaging blank 900 via, for example, an adhesive or double-sided tape. In particular, seventh panel 822 of retractable handle blank 800 may be coupled to first section 904 of packaging blank 900 and eighth panel 824 of retractable handle blank 800 may be coupled to second section 906 of packaging blank 900 such that retractable handle blank 800 is disposed over wings 910 and 912 (e.g., as shown in FIG. 7A). After coupling retractable handle blank 800 to packaging blank 900, packaging blank 900 may be folded along its fold lines into packaging body 110. For example, frame sections 930 may be folded to form frames 180 and 182 (e.g., as shown in FIG. 7A) and then first section 904 and second section 906 may be folded about spine 902 to close packaging body 110 (e.g., as shown in FIG. 2).

Figure 10:
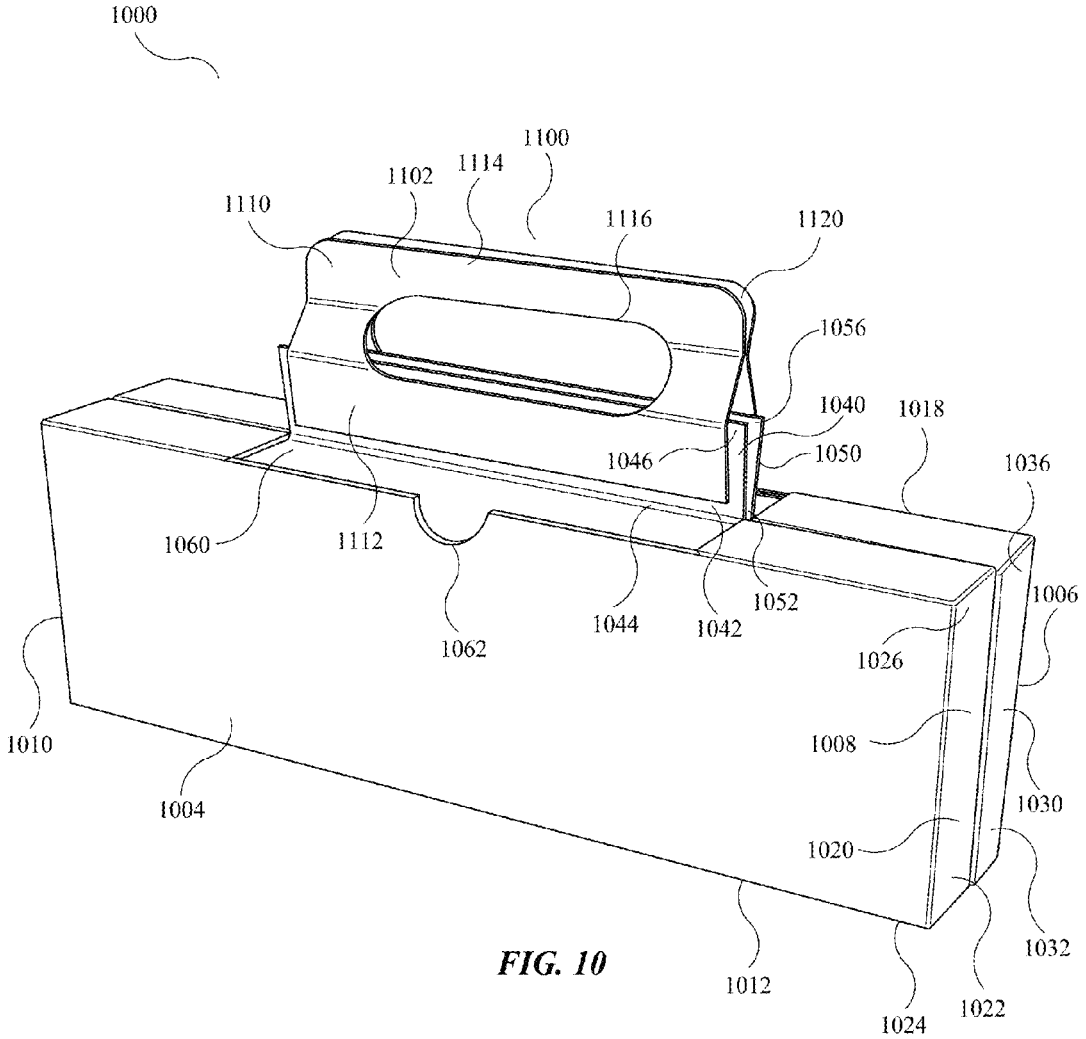
FIG. 10 shows a perspective view of packaging in a closed position with a retractable handle in an erect position according to an embodiment.

FIG. 10 shows packaging 1000 according to an embodiment. Packaging 1000 may include a packaging body 1010 and a retractable handle 1100. Packaging body 1010 may be configured to house one or more products (e.g., products 101) in the same or similar fashion as packaging body 110 (e.g., as shown in FIG. 1). In some embodiments, packaging body 1010 may include a product cavity the same as or similar to product cavity 102 for holding one or more products.

Packaging body 1010 may be the same or similar to packaging body 110 discussed, for example, in regards to FIGS. 1, 2, and 7. For example, packaging body 1010 may include a first section 1020 the same as or similar to first section 120 and a second section 1030 the same as or similar to second section 130. First section 1020 and second section 1030 may be configured to rotate relative to each other (i.e., towards and away from each other) between an open position (see e.g., FIG. 16) and a closed position (see e.g., FIG. 10) to open and close packaging 1000.

In some embodiments, first section 1020 and second section 1030 may both be hingedly coupled to a spine 1012. Similar to packaging body 110, spine 1012 may serve as the closed end of packaging 1000. First section 1020 may include a fixed end 1022 hingedly coupled to spine 1012 via a hinged coupling 1024 and a free end 1026 disposed opposite fixed end 1022. Similarly, second section 1030 may include a fixed end 1032 hingedly coupled to spine 1012 via a hinged coupling 1034 and a free end 1036 disposed opposite fixed end 1032. Free ends 1026 and 1036 may define an openable end 1018 of packaging 1000. Hinged couplings 1024 and 1034 may be the same as or similar to hinged couplings 124 and 134.

Second section 1030 and first section 1020 may define a front wall 1004 and a back wall 1006 of packaging 1000. Together, spine 1012, first section 1020, and second section 1030 may define a perimeter wall 1008 of packaging 1000.

Figure 11:
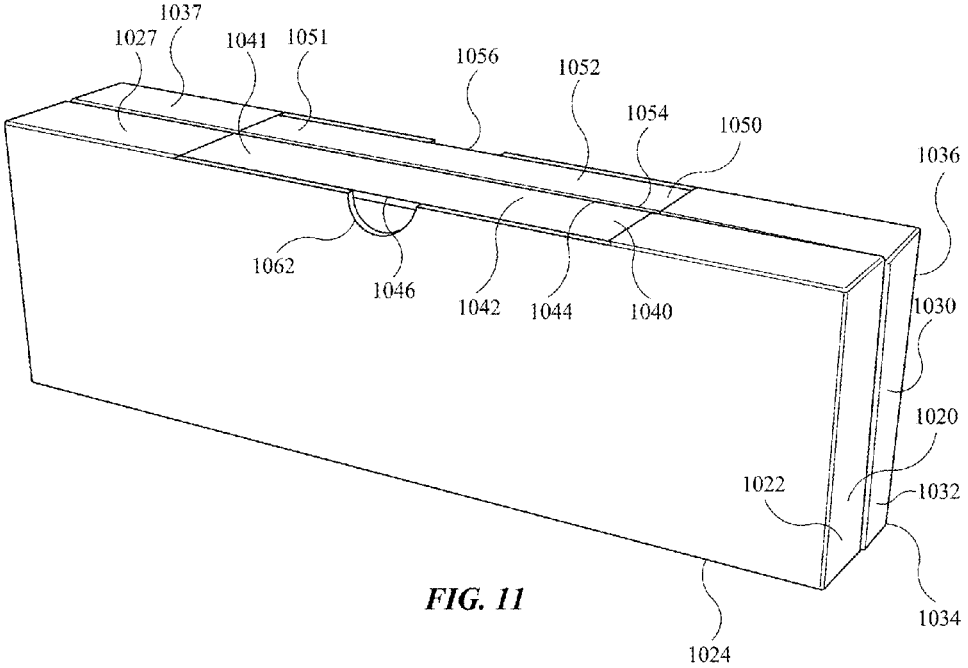
FIG. 11 shows a perspective view of packaging in a closed position with a retractable handle in a retracted position according to an embodiment.

Retractable handle 1100 of packaging 1000 may be disposed on free ends 1026 and 1036 of first section 1020 and second section 1030. As shown, for example in FIGS. 10 and 11, retractable handle 1100 may be configured to reversibly move between an erect position (FIG. 10) and a retracted position (FIG. 11). In the erect position, retractable handle 1100 extends from (e.g., above) packaging body 1010 such that it can be grasped by a user. In the retracted position, retractable handle 1100 may be disposed, at least partially, within packaging body 1010 of packaging 1000. In some embodiments, retractable handle 1100 may be entirely disposed within packaging body 1010 when in the retracted position.

In some embodiments, packaging body 1010 may include a rotatable flaps configured to conceal retractable handle 1100 within packaging body 1010 when retractable handle 1100 is in the retracted position. In some embodiments, first section 1020 of packaging body 1010 may include a first flap 1040 hingedly coupled to free end 1026 of first section 1020. Flap 1040 may include a fixed end 1042 hingedly coupled to free end 1026 of packaging body 1010 and a free end 1046 disposed opposite fixed end 1042. Fixed end 1042 may be hingedly coupled to free end 1026 of packaging body 1010 via a hinged coupling 1044. First flap 1040 may be configured to rotate between an open position (see e.g., FIG. 10) and a closed position (see e.g., FIG. 11) to open and close a first compartment 1060 defined by first section 1020. In some embodiments, first compartment 1060 may be formed in free end 1026 of first section 1020.

Similar to first section 1020, second section 1030 of packaging body 1010 may include a second flap 1050 hingedly coupled to free end 1036 of second section 1030. Flap 1050 may include a fixed end 1052 hingedly coupled to free end 1036 of second section 1030 and a free end 1056 disposed opposite fixed end 1052. Fixed end 1052 may be hingedly coupled to free end 1036 of packaging body 1010 via a hinged coupling 1054. First flap 1050 may be configured to rotate between an open position (see e.g., FIG. 10) and a closed position (see e.g., FIG. 11) to open and close a second compartment 1070 defined by second section 1030. In some embodiments, second compartment 1070 may be formed in free end 1036 second section 1030.

In some embodiments, flaps 1040 and 1050 may completely cover first compartment 1060 and second compartment 1070, respectively, when they are in their closed positions. In some embodiments, flaps 1040 and 1050 may define a portion of the part of packaging body 1010 to which they are hingedly coupled when in their closed position (e.g., flaps 1040/1050 may define a portion of free end 1026 and free end 1036, respectively, when in their closed position). In some embodiments, the top surfaces 1041 and 1051 of flaps 1040 and 1050 may be flush with the surface of packaging body 1010 to which flaps 1040/1050 are hingedly coupled when flaps 1040 and 1050 are in their closed position. For example, top surfaces 1041 and 1051 may be flush with a top surface 1027 of free end 1026 and a top surface 1037 of free end 1036 when flaps 1040 and 1050 are in their closed position. In some embodiments, first flap 1040 and second flap 1050 may be disposed in a back-to-back configuration when first section 1020 and second section 1030 are both in their closed position. In such embodiments, hinged coupling 1044 may be positioned immediately adjacent to hinged coupling 1054 when first section 1020 and second section 1030 are both in their closed position.

Retractable handle 1100 may include a first foldable wall 1110 and a second foldable wall 1120 configured to define a handgrip 1102 of retractable handle 1100. First foldable wall 1110 may include a fixed end 1112 coupled to first flap 1040 and a retractable end 1114 disposed opposite fixed end 1112. Similarly, second foldable wall 1120 may include a fixed end 1122 coupled to second flap 1050 and a retractable end 1124 disposed opposite fixed end 1122 (see e.g., FIG. 14). In the retracted position of retractable handle 1100, flaps 1040 and 1050 may be closed and first foldable wall 1110 and second foldable wall 1120 may be concealed within compartments 1060 and 1070, respectively. In other words, first compartment 1060 may be configured to house first foldable wall 1110 when first flap 1040 is in its closed position and second compartment 1070 may be configured to house second foldable wall 1120 when second flap 1050 is in its closed position.

In the erect position of retractable handle 1100, flaps 1040 and 1050 may be open to expose first foldable wall 1110 and second foldable wall 1120 to allow a user to grasp retractable handle 1100 via handgrip 1102. In some embodiments, retractable ends 1114 and 1124 of foldable walls 1110 and 1120 may be configured to be coupled together to form handgrip 1102 when first flap 1040 and second flap 1050 are in their open positions. In some embodiments, foldable wall 1110 or foldable wall 1120 may include a connector (e.g., connector 1128 shown in FIGS. 13 and 14) configured to couple retractable ends 1114/1124 of foldable walls 1110/1120.

In some embodiments, first foldable wall 1110 and second foldable wall 1120 may be composed of a number of panels hingedly coupled together and configured to allow retractable handle 1100 to reversibly fold into and unfold from packaging body 1010. For example, as shown in FIGS. 13-15, in some embodiments, first foldable wall 1110 and second foldable wall 1120 may each include a first panel 1130 coupled packaging body 1010 and defining the fixed end 1112/1122 of the foldable wall 1110/1120, a second panel 1134 hingedly coupled to first panel 1130 via a hinged coupling 1132, and a third panel 1138 hingedly coupled to second panel 1134 via a hinged coupling 1136.

In some embodiments, second panels 1134 and third panels 1138 of foldable walls 1110/1120 may define handgrip 1102 of retractable handle 1100. In such embodiments, second panels 1134 and third panels 1138 of foldable walls 1110/1120 may include through holes 1116 and 1126, respectively. In some embodiments, through holes 1116 and 1126 may extend through hinged couplings 1136 on foldable walls 1110/1120.

Hinged couplings 1132 and 1136 may include, but are not limited to, structurally weakened regions on retractable handle 1100. Structurally weakened regions may include, but are not limited to, grooves formed in foldable walls 1110 and 1120, fold lines, and perforated lines. Grooves may be formed by removing material from a surface of foldable walls 1110/1120. For example, grooves may be V-shaped or U-shaped grooves formed in a surface of first foldable wall 1110 and second foldable wall 1120. In some embodiments, fold lines may be formed by removing material from a surface of foldable walls 1110/1120.

Figure 12:
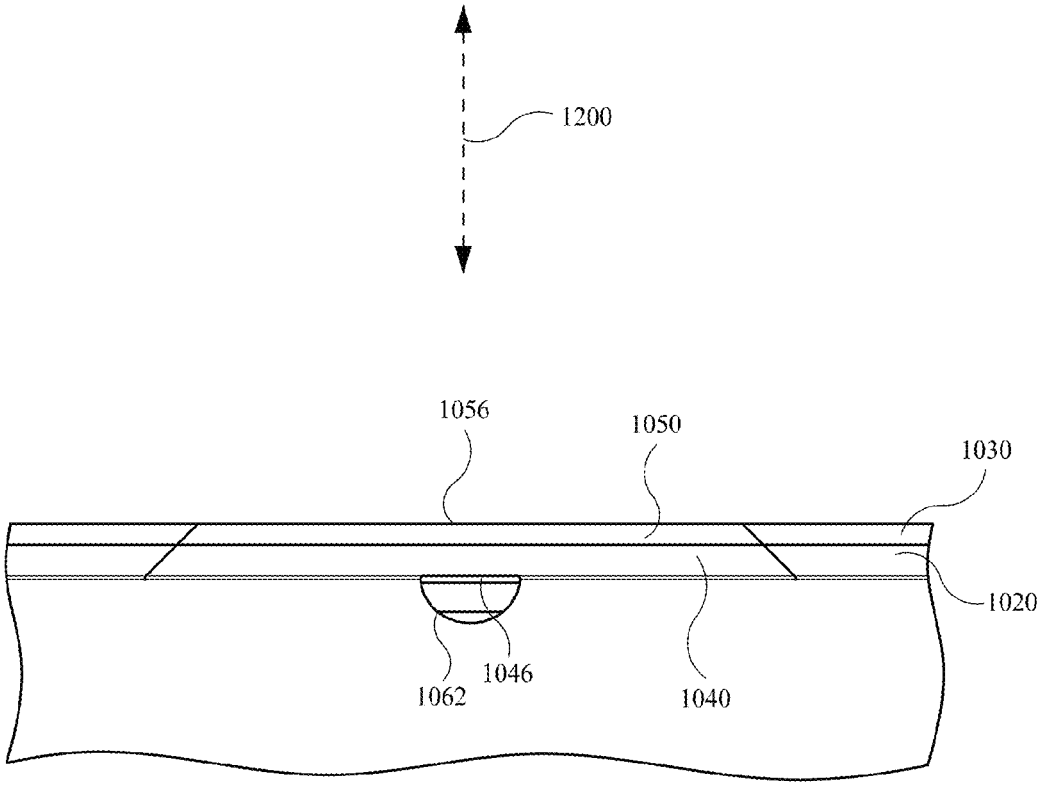
FIG. 12 shows a perspective view a retractable handle in a retracted position according to an embodiment.
Figure 13:
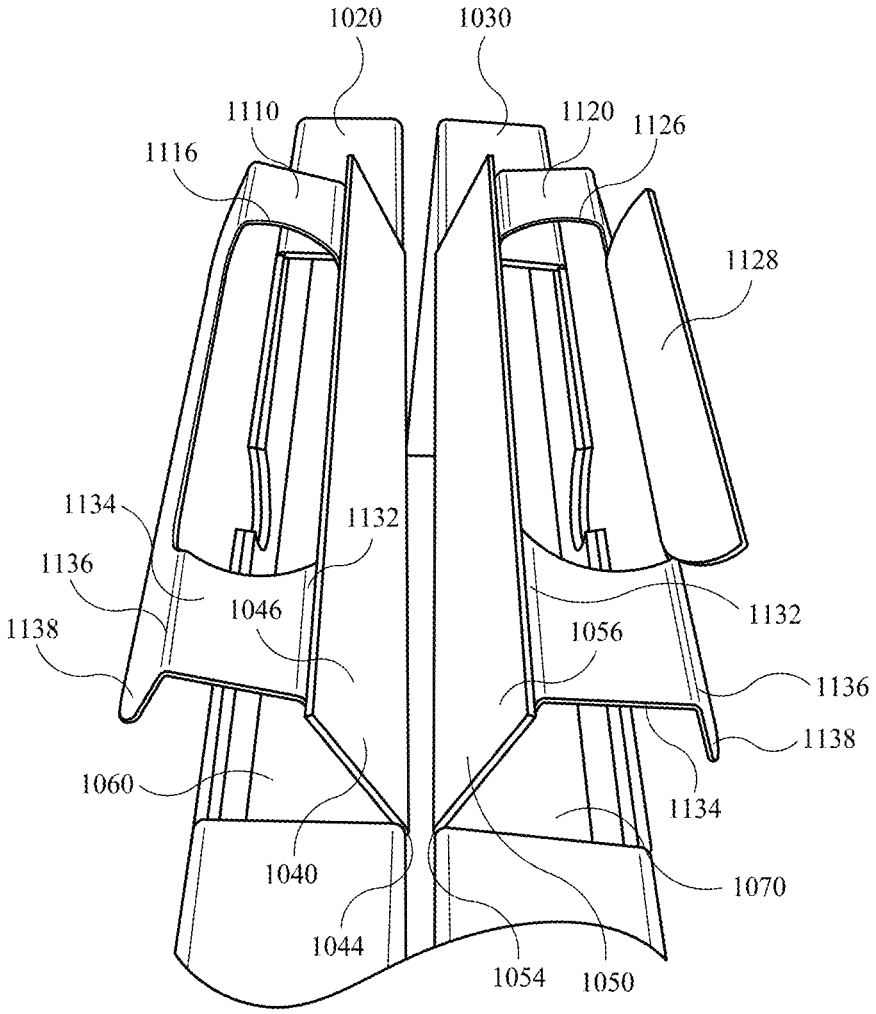
FIG. 13 shows a perspective view of a retractable handle in a partially erect position according to an embodiment.
Figure 14:
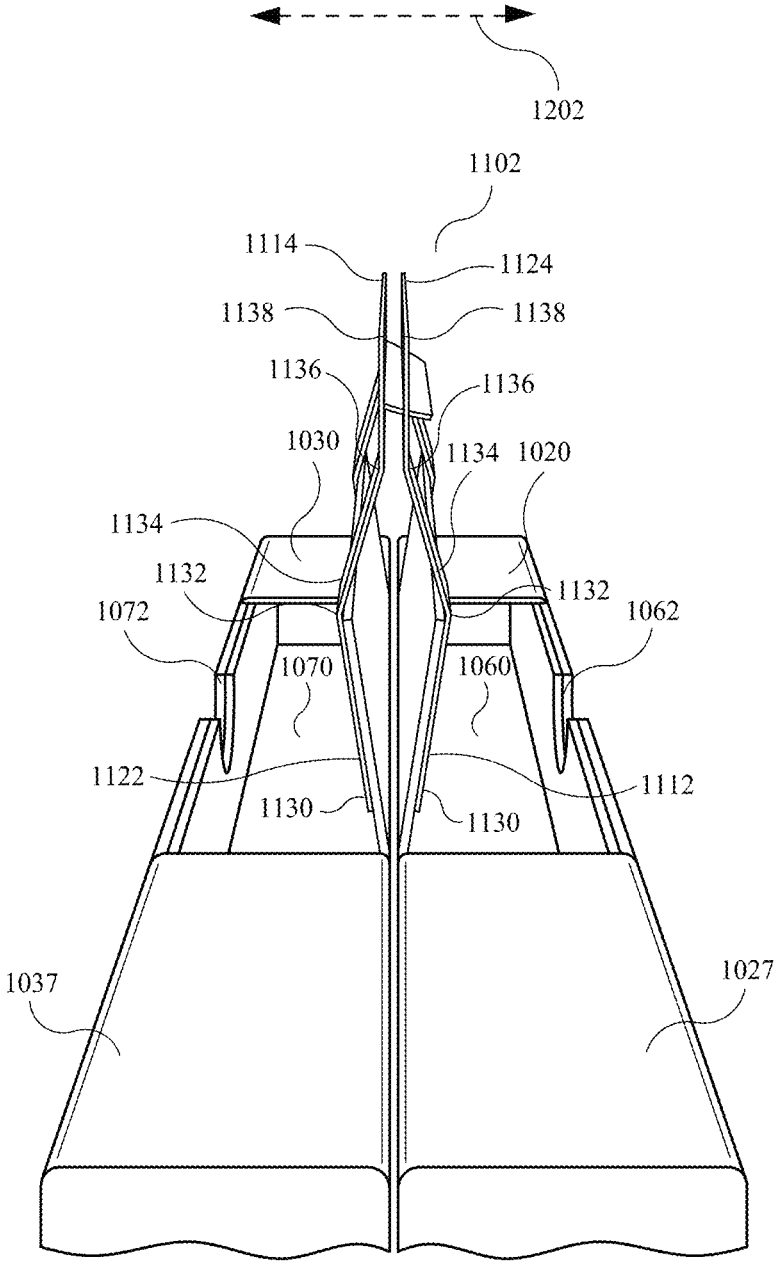
FIG. 14 shows a perspective view of a retractable handle in an erect position according to an embodiment.
Figure 15:
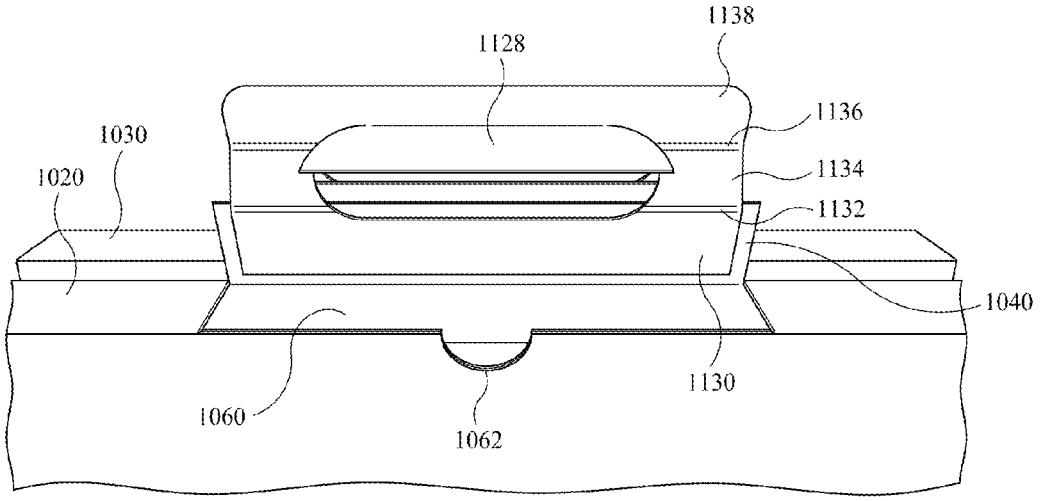
FIG. 15 shows a perspective view of a retractable handle in an erect position according to an embodiment.

FIGS. 12-14 show the movement of retractable handle 1100 between a retracted position (FIG. 12) and an erect position (FIG. 14) according to an embodiment. As shown in FIG. 12, retractable handle 1100 may be concealed within packaging body 1010 when in the retracted position. In such embodiments, flaps 1040/1050 may hide retractable handle 1100 from view.

FIG. 13 shows retractable handle 1100 in a partially erect position above packaging body 1010. As shown in FIG. 13 the movement of retractable handle 1100 towards the erect position includes flaps 1040/1050 rotating from their closed positions towards their open positions. Flaps 1040/1050 may rotate in an upward direction (i.e., upward in vertical direction 1200) and inward direction (i.e., in opposite horizontal directions along horizontal direction 1202 shown, for example, in FIG. 14). A user may rotate flaps 1040/1050 by grasping flaps and rotating them toward their open positions. In some embodiments, packaging body 1010 may include finger holes 1062 and 1072 to help a user move flaps 1040 and 1050 from their closed positions to their open positions. Finger holes 1062 may be disposed on free end 1026 of first section 1020 adjacent to compartment 1060. In some embodiments, finger hole 1062 may be a through hole in communication with compartment 1060. Finger hole 1072 may be disposed on free end 1036 of second section 1030 adjacent to compartment 1070. In some embodiments, finger hole 1072 may be a through hole in communication with compartment 1070.

As retractable handle 1100 moves towards the erect position, second panels 1134 and third panels 1138 of first foldable wall 1110 and second foldable wall 1120 may be begin to unfold about hinged couplings 1132 and 1136, respectively, in an upward direction (i.e., upward in vertical direction 1200) and an inward direction (i.e., in opposing horizontal directions along horizontal direction 1202). As shown in FIG. 14, flaps 1040/1050 may be oriented in a vertical direction substantially perpendicular to top surfaces 1027 and 1037 of free ends 1026 and 1036 when retractable handle 1100 is in the erect position.

While the order of FIGS. 12-14 shows the movement of retractable handle 1100 from the retracted position to the erect position, the movement of retractable handle 1100 from the erect position to the retraced position, as well as the movement of flaps 1040/1050 from their open positions to their closed positions, is shown when viewing FIGS. 12-14 in reverse order.

Figure 16:
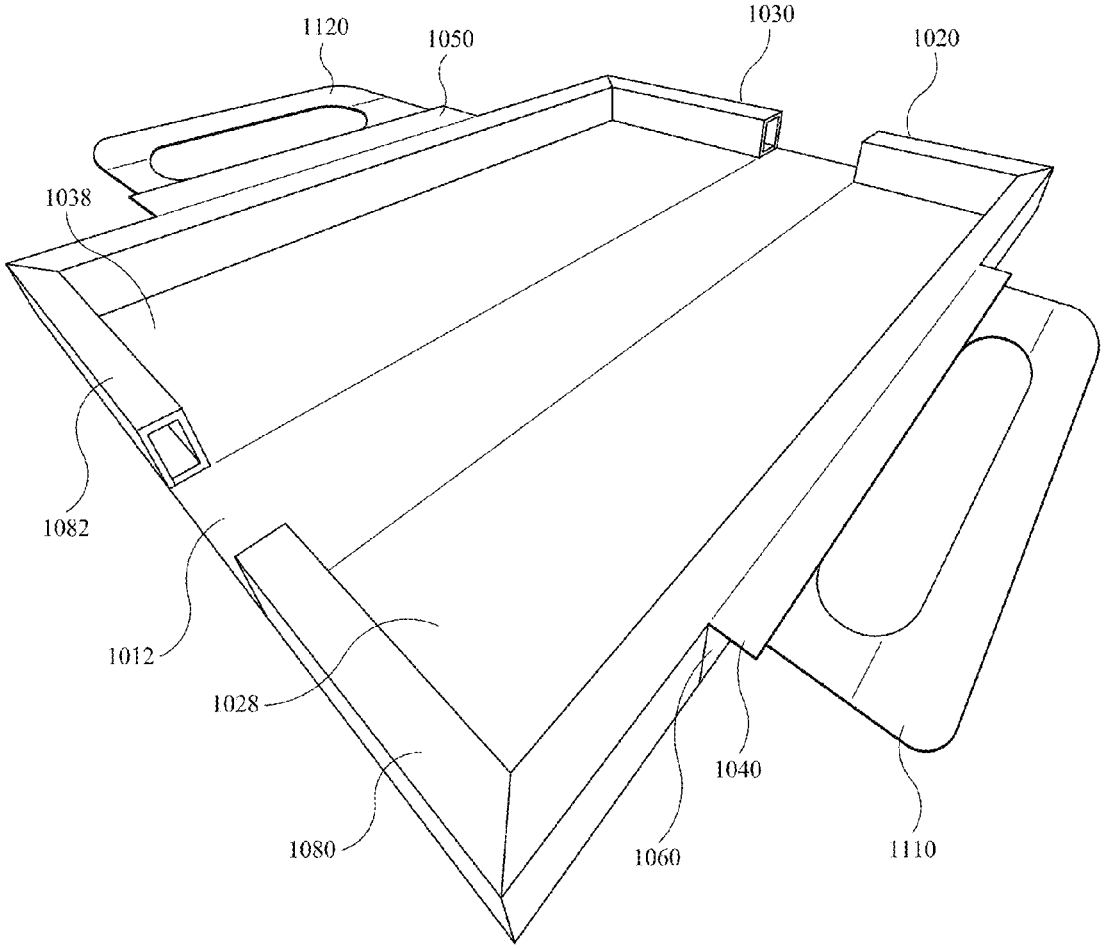
FIG. 16 shows a perspective view of packaging in an open position according to an embodiment.

FIG. 16 shows packaging 1000 according to an embodiment in an open position with the interior of packaging 1000 exposed. Similar to packaging body 110, packaging body 1010 may include a first cavity 1028 defined by first section 1020 and a second cavity 1038 defined by second section 1030. In some embodiments, a frame 1080 may be disposed along at least a portion of the perimeter of first section 1020 and may define a portion of first cavity 1028. In some embodiments, a frame 1082 disposed along at least a portion of the perimeter of second section 1030 and may define a portion of second cavity 1038. Frames 1080 and 1082 may be the same as or similar to frames 180 and 182. First cavity 128 and/or second cavity 138 may define a product cavity for holding product(s) within packaging body 1010.

In some embodiments, frame 1080 may define first compartment 1060 of first section 1120 and first flap 1040 may be hingedly coupled to frame 1080. In some embodiments, first flap 1040 may be integrally formed with frame 1080 (e.g., first flap 1040 may be cut from frame 1080). In some embodiments, frame 1082 may define second compartment 1070 of second section 1130 and second flap 1050 may be hingedly coupled to frame 1082. In some embodiments, second flap 1050 may be integrally formed with frame 1082 (e.g., second flap may be cut from frame 1082).

Figure 17:
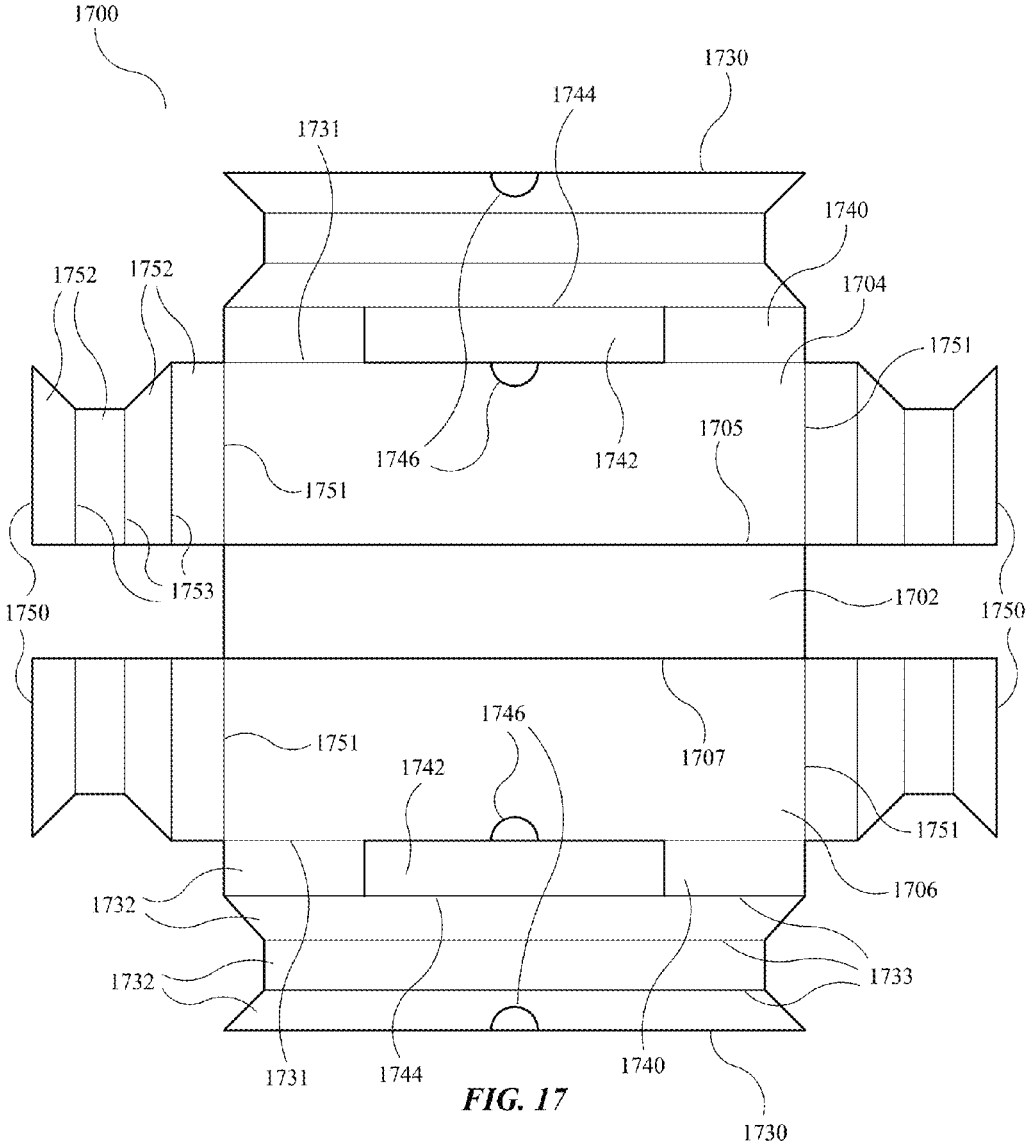
FIG. 17 shows a packaging blank according to an embodiment.

FIG. 17 shows a packaging blank 1700 for forming packaging body 1010 according to an embodiment. Packaging blank 1700 may include a spine 1702 connected to a first section 1704 along a first side of spine 1702 by an upward fold line 1705 and connected to a second section 1706 along a second, opposite side of spine 1702 by an upward fold line 1707.

In some embodiments, packaging blank 1700 may include two top frame sections 1730 connected to the top sides of first section 1704 and second section 1706 by upward fold lines 1731. Top frame sections 1730 may include a set of panels 1732 configured to fold about a set of upward fold lines 1733 and upward fold line 1731 into a hollow polygonal shape (e.g., square shape) to form portion of frames 1080 and 1082 of packaging body 1010. Top frame sections 1730 may include an innermost panel 1740 connected to first section 1704 and second section 1706, respectively, by upward fold lines 1705 and 1707. Flaps 1724 and be cut from innermost panels 1740 and may be connected to top frame sections 1730 via downward fold lines 1744. Flaps 1724 may define flaps 1040 and 1050 on packaging body 1010. In some embodiments, packaging blank 1700 may include cut-outs 1746 that define finger holes 1062 and 1072 on packaging body 1010.

In some embodiments, packaging blank 1700 may include a plurality of side frame sections 1750 connected to the perimeter sides of first section 1704 and second section 1706 by upward fold lines 1751. Side frame sections 1750 may include a set of panels 1752 configured to fold about a set of upward fold lines 1753 and upward fold line 1751 into a hollow polygonal shape (e.g., square shape) to form portions of frames 1080 and 1082 of packaging body 1010.

In some embodiments, packaging blank 1700 include cushioning elements and the cushioning elements may be the same or similar as cushioning elements 936 discussed in regards to FIG. 9. Frame sections 1730 and 1750 may be folded into portions of frames 1080/1082 may be coupled to first section 1704 and second section 1706 via attachment mechanisms and the attachment mechanisms may be the same as or similar to attachment mechanisms 940 discussed in regards to FIG. 9.

Figure 18:
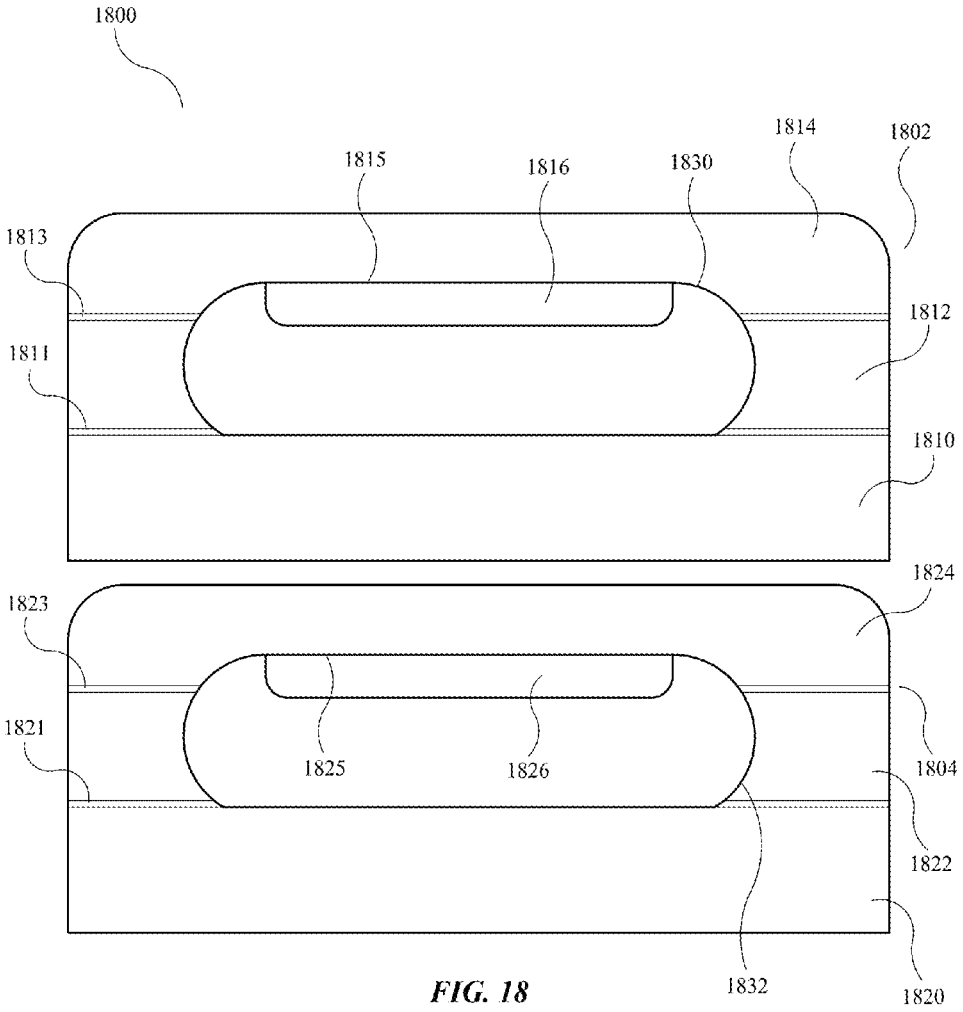
FIG. 18 shows a set of blanks for a retractable handle according to an embodiment.

FIG. 18 shows a set of blanks 1800 for forming a retractable handle 1100 according to an embodiment. Set of blanks 1800 may include a first handle wall blank 1802 and a second handle wall blank 1804 for forming first foldable wall 1110 and second foldable wall 1120. First handle wall blank 1802 may include a first panel 1810 connected to a second panel 1812 by a downward fold line 1811. First handle wall blank 1802 may also include a third panel 1814 connected to second panel 1812 by an upward fold line 1813. The opposite folding direction of fold lines 1811 and 1813 may facilitate folding of foldable wall 1110 into and out of compartment 1060 on packaging body 1010. In some embodiments, first handle wall blank 1802 may include a first through hole 1830 formed in first panel 1810 and second panel 1812.

Second handle wall blank 1804 may include a first panel 1820 connected to a second panel 1822 by a downward fold line 1821. Second handle wall blank 1804 may also include a third panel 1824 connected to second panel 1822 by an upward fold line 1823. The opposite folding direction of fold lines 1821 and 1823 may facilitate folding of foldable wall 1120 into and out of compartment 1070 on packaging body 1010. In some embodiments, second handle wall blank 1804 may include a second through hole 1832 formed in first panel 1820 and second panel 1822. Together, first through hole 1830 and second through hole 1832 may define a through hole for handgrip 1102 on retractable handle 1100. In some embodiments, first handle wall blank 1802 and second handle wall blank 1804 may be substantially the same.

In some embodiments, first handle wall blank 1802 may include a fourth panel 1816 connected to third panel 1814 by a fold line 1815 and extending into through hole 1830. Similarly, in some embodiments, second handle wall blank 1804 may include a fourth panel 1826 extending into through hole 1832 and connected to third panel 1824 by a fold line 1825. In embodiments including fourth panels 1816 and 1826, these panels may fold so as to at least partially overlap to form a triangular shape with third panel 1814 and third panel 1824. In such embodiments, this triangular shape may serve to disperse the weight of packaging 1000 and the product(s) housed within packaging body 1010 across a larger surface area on a user's hand, thereby increasing the comfort level for handgrip 1102.

In some embodiments, packaging blank 1700 and set of blanks 1800 may be assembled to form packaging 1000. In some embodiments, packaging blank 1700, and components thereof (e.g., flaps 1040/1050 and frame sections 1730/1750), may be cut from a paper-based material. In some embodiments, the cutting of packaging blank 1700 may include forming fold lines on packaging blank 1700 (e.g., by removing material from the surface of packaging blank 1700 or otherwise structurally weakening areas on packaging blank 1700 corresponding to the location of the fold lines on packaging blank 1700).

In some embodiments, set of blanks 1800, and components thereof, may be cut from a paper-based material. In some embodiments, the cutting of set 1800 may include forming fold lines on first handle wall blank 1802 and second handle wall blank 1804. Fold lines on first handle wall blank 1802 and second handle wall blank 1804 may be formed in the same fashion as those formed on packaging blank 1700.

When assembling packaging 1000, first handle wall blank 1802 and second handle wall blank 1804 may be coupled to flaps 1742 on packaging blank 1700 via, for example, an adhesive or double-sided tape. In particular, first panels 1810 and 1820 of first handle wall blank 1802 and second handle wall blank 1804 may be coupled to flaps 1742 on packaging blank 1700. After coupling first handle wall blank 1802 and second handle wall blank 1804 to packaging blank 1700, packaging blank 1700 may be folded along its fold lines into packaging body 1010. For example, frame sections 1730 and 1750 may be folded to form frames 1080 and 1082 (e.g., as shown in FIG. 16). Then first section 1704 and second section 1706 may be folded about spine 1702 to close packaging body 1010 (e.g., as shown in FIG. 10).

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention(s). Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention(s) as contemplated by the inventor(s), and thus, are not intended to limit the present invention(s) and the appended claims.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention(s) should not be limited by any of the above-described exemplary embodiments, but should be defined only in accordance with the following claims and their equivalents.

What is claimed is:

1. Packaging for a product, the packaging comprising:
- an opening and opposing wings configured to at least partially cover the opening, each wing hingedly coupled to the packaging and comprising a slot; and
- a retractable handle comprising:
  - a first foldable wall hingedly coupled to a second foldable wall at a retractable end of the retractable handle, the first foldable wall comprising a fixed end coupled to a first internal surface of the packaging and the second foldable wall comprising a fixed end coupled to a second internal surface of the packaging,
  - a handgrip at the retractable end of the retractable handle, and
  - opposing tabs disposed at the retractable end and configured to slide within the slots on the wings of the packaging,
- wherein the retractable handle is configured to fold and unfold between a retracted position and an erect position,
- wherein the retractable end of the retractable handle is disposed within the packaging in the retracted position, and
- wherein the retractable end of the retractable handle extends above the opening and the opposing tabs are disposed within the slots of the opposing wings in the erect position.

2. The packaging of claim 1, wherein the retractable handle is a single integrally formed piece.

3. The packaging of claim 2, wherein the retractable handle is formed of a paper-based material selected from the group consisting of: cardboard and paperboard.

4. The packaging of claim 1, wherein the opposing tabs are configured to mate with upper ends of the slots on the wings when the retractable handle is in the erect position.

5. The packaging of claim 1, comprising a pull tab coupled to the retractable end of the retractable handle, wherein pulling the pull tab moves the retractable handle from the retracted position to the erect position.

6. The packaging of claim 1, wherein the first foldable wall and the second foldable wall are substantially the same.

7. The packaging of claim 1, wherein the first foldable wall and the second foldable wall each comprise:
- a first panel coupled to the packaging and defining the fixed end of the foldable wall,
- a second panel hingedly coupled to the first panel,
- a third panel hingedly coupled to the second panel, and
- a fourth panel hingedly coupled to the third panel, the fourth panels of the foldable walls defining at least a portion of the retractable end of the retractable handle.

8. The packaging of claim 7, wherein the third panels of the first foldable wall and the second foldable wall are configured to bias the retractable handle in the retracted position until the retractable handle is moved a predetermined amount from the retracted position towards the erect position.

9. The packaging of claim 7, wherein the handgrip comprises a through hole defined by the first foldable wall and the second foldable wall.

10. The packaging of claim 1, wherein the wings are integrally formed with the packaging.

11. The packaging of claim 1, wherein the packaging comprises a spine, a first section hingedly coupled to the spine, and a second section hingedly coupled to the spine, and wherein the first section and the second section are configured to rotate away from and towards each other between an open position and a closed position to open and close the packaging.

12. The packaging of claim 11, wherein the opening is disposed on the spine.

13. The packaging of claim 11, wherein the first section comprises a first cavity and the second section comprises a second cavity, and wherein the first cavity and the second cavity define a product cavity for holding a product.

14. The packaging of claim 11, wherein first section comprises a first cavity defined by the first internal surface and a first frame disposed along at least a portion of the perimeter of the first section, and wherein the second section comprises a second cavity defined by the second internal surface and a second frame disposed along at least a portion of the perimeter of the second section.

15. Packaging for a product, the packaging comprising:
- a packaging body composed of a paper-based material;
- a retractable handle composed of a paper-based material, the retractable handle comprising a first foldable wall and a second foldable wall, wherein each foldable wall comprises:
  - a first panel coupled the packaging body and defining a fixed end of the foldable wall,
  - a second panel hingedly coupled to the first panel,
  - a third panel hingedly coupled to the second panel, and
  - a fourth panel hingedly coupled to the third panel, the fourth panels of the foldable walls defining at least a portion of a retractable end of the retractable handle; and
- a handgrip comprising a through hole defined by the first foldable wall and the second foldable wall,
- wherein the retractable handle is configured to fold and unfold between a retracted position and an erect position, and wherein the retractable handle is disposed within the packaging in the retracted position and extends from the packaging in the erect position.

16. The packaging of claim 15, wherein the paper-based material of the packaging body and the retractable handle is selected from the group consisting of: cardboard and paperboard.

17. The packaging of claim 15, wherein the first foldable wall and the second foldable wall are a single integrally formed piece.

18. The packaging of claim 15, wherein the handgrip is defined by the third and fourth panels of the first foldable wall and the second foldable wall.

19. The packaging of claim 15, comprising an opening and opposing wings hingedly coupled to opposite sides of the opening.

20. The packaging of claim 19, wherein the retractable handle is configured to fold and unfold from the opening.

21. The packaging of claim 20, wherein the fourth panel of the first foldable wall and the fourth panel of the second foldable wall comprise opposing tabs disposed on opposite sides of the first foldable wall and the second foldable wall, and wherein the opposing tabs are configured to slide within opposing slots defined by the opposing wings as the retractable handle is folded and unfolded.

22. The packaging of claim 15, wherein the packaging body is a single integrally formed piece.

23. The packaging of claim 15, wherein the packaging body comprises a cavity for holding a product.

24. A packaged product comprising:

the packaging of claim 23; and a product disposed within the cavity of the packaging body.

25. The packaging of claim 15, wherein the third panels of the first foldable wall and the second foldable wall are configured to bias the retractable handle in the retracted position until the retractable handle is moved a predetermined amount from the retracted position towards the erect position.

26. The packaging of claim 25, wherein the predetermined amount is greater than half way between the retracted position and the erect position.

27. The packaging of claim 15, wherein the third panels of the first foldable wall and the second foldable wall are configured to bias the retractable handle in the retracted position until the third panels are moved past a predetermined position.

28. The packaging of claim 27, wherein the predetermined position is substantially perpendicular to an internal surface of the packaging.

29. The packaging of claim 21, wherein the opposing tabs are defined by the fourth panels of the first foldable wall and the second foldable wall.

30. The packaging of claim 15, wherein the handgrip comprises a through hole defined by the first foldable wall and the second foldable wall.

31. Packaging for a product, the packaging comprising:

a spine, a first section comprising a fixed end hingedly coupled to the spine and a free end opposing the fixed end comprising a first flap hingedly coupled to the free end;

a second section comprising a fixed end hingedly coupled to the spine and a free end opposing the fixed end comprising a second flap hingedly coupled to the free end; and a retractable handle comprising a first foldable wall having a first end coupled to the first flap and a second end disposed opposite the first end, and a second foldable wall having a first end coupled to the second flap and a second end disposed opposite the first end;

wherein the first flap and the second flap are configured rotate between a closed position and an open position, wherein the first foldable wall and second foldable wall are concealed when the flaps are in the closed position and the first foldable wall and the second foldable wall are exposed wherein the flaps are in the open position, and wherein the second ends of the first foldable wall and the second foldable wall are configured to define a handgrip of the retractable handle when the first flap and the second flap are in the open position.

32. The packaging of claim 31, wherein the first section comprises a first cavity and the second section comprises a second cavity, and wherein the first cavity and the second cavity define a product cavity for holding a product.

33. The packaging of claim 31, wherein the first section and the second section are configured to rotate away from and towards each other between an open position and a closed position to open and close the packaging.

34. The packaging of claim 31, comprising a first compartment defined by the first section and reversibly covered by the first flap and a second compartment defined by the second section and reversibly covered by the second flap.

35. The packaging of claim 34, wherein the first compartment is configured to house the first foldable wall when the first flap is in the closed position and wherein the second compartment is configured to house the second foldable wall when the second flap is in the closed position.

36. The packaging of claim 31, wherein the first section comprises a cavity defining at least a portion of a product cavity for holding a product.

* * * * *